United States Patent [19]

Osteen et al.

[11] Patent Number: 4,896,474

[45] Date of Patent: Jan. 30, 1990

[54] SPACER-TRAY LOADING MACHINE

[75] Inventors: John F. Osteen; Bernard R. Marks; Frederick J. Szeliga, all of Lynchburg, Va.

[73] Assignee: International Container Systems, Inc., Tampa, Fla.

[21] Appl. No.: 105,780

[22] Filed: Oct. 6, 1987

[51] Int. Cl.[4] ..... B65B 21/08; B65B 35/26; B65B 5/10

[52] U.S. Cl. ..... 53/48; 53/534; 53/246

[58] Field of Search ..... 53/534, 246, 539, 247, 53/251, 48

[56] References Cited

U.S. PATENT DOCUMENTS

| | | | |
|---|---|---|---|
| 2,993,621 | 7/1961 | Mumma | 53/246 X |
| 3,224,575 | 12/1965 | Whiteford | 53/48 |
| 3,314,212 | 4/1967 | Peppler | 53/246 X |
| 3,314,213 | 4/1967 | Peppler | 53/246 X |
| 3,336,723 | 8/1967 | Shazor, Jr. | 53/48 X |
| 3,426,501 | 2/1969 | Earp | 53/48 |
| 3,570,211 | 3/1971 | Gordon et al. | 53/251 X |
| 4,429,512 | 2/1984 | Pegon, Jr. | 53/251 X |

*Primary Examiner*—Horace M. Culver
*Attorney, Agent, or Firm*—W. G. Marple, Jr.; N. L. Coch; J. E. Kidd

[57] ABSTRACT

A spacer-tray loading machine loads cans or other containers into nestable spacer trays. The spacer trays are shaped with a plurality of container-bottom receptacles in a row-column array and nest together when empty to form a stack. The spacer-tray loading machine comprises a multiple-lane container feeder for supplying containers arranged in parallel rows to a tray loading area of the machine. The number of lanes equals the number of columns of container-bottom receptacles in the spacer tray. The spacer-tray loading machine further comprises a stacked-tray supply conveyor for advancing a horizontal stack of trays towards a tray-withdrawal end of the stack. The spacer-track loading machine also includes a tray feeder utilizing a pivotally mounted pull-and-drop arm for withdrawing spacer trays one at a time from the stack and utilizing at least one air-blast nozzle for translating and reorienting the trays thus withdrawn to supply trays to the tray loading area in an approximately horizontal orientation below the rows of containers from the container feeder and with the rows of container-bottom receptacles of the trays extending substantially perpendicular to the rows of containers. The spacer-tray loading machine also comprises a metering tray loader for advancing containers and trays effectively in synchronism through the tray loading area and for seating bottom portions of the containers in the container-bottom receptacles of the trays as the containers and trays advance.

27 Claims, 17 Drawing Sheets

FIG. 11
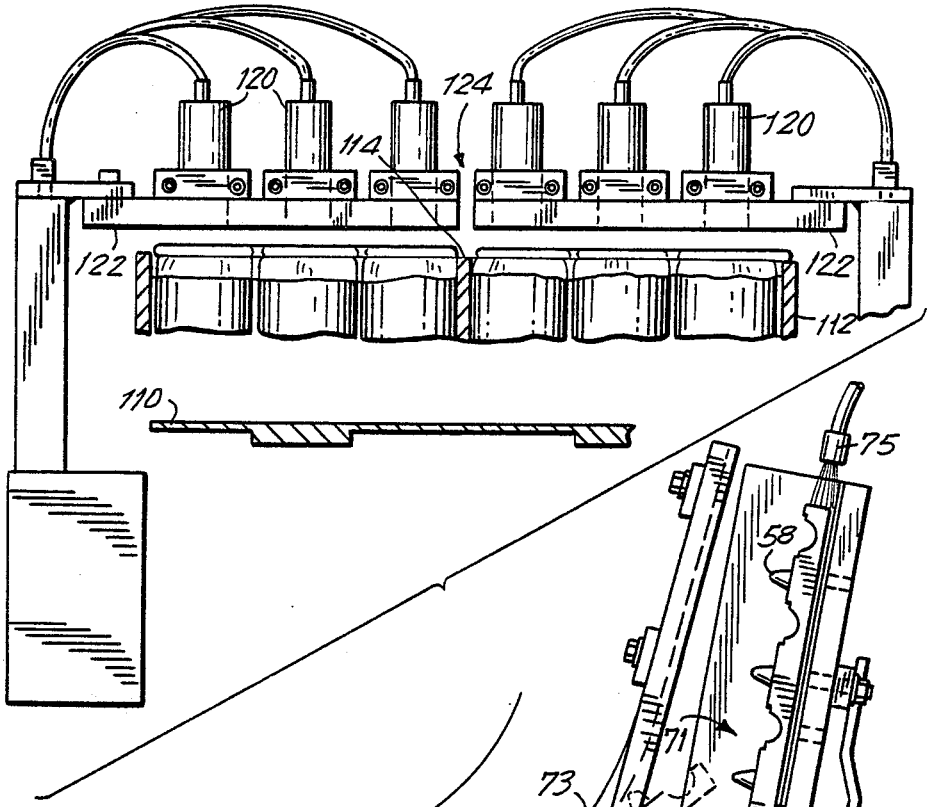
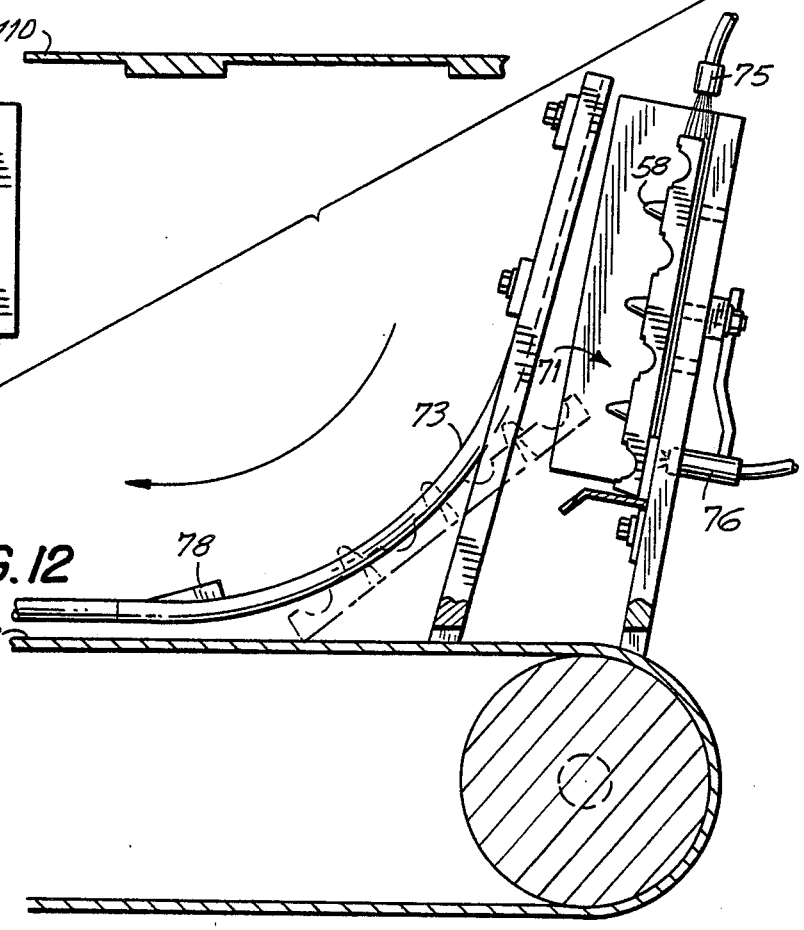
FIG. 12

170
184
192
190
200
196
35
174
180
178
194
172
176
182

TRAY-FEEDER TIMING SHAFT ROTATION ANGLE

SPACER-TRAY LOADING MACHINE

TECHNICAL FIELD

The present invention relates to a machine for loading trays with containers such as cans of beverage.

BACKGROUND ART

Beverages such as beer and soft drinks are frequently packaged in cans which are marketed to consumers in groups termed "multipacks," with the group of six cans termed the "six pack" being the most popular. Six packs are typically shipped from the producer to the retailer in open-topped, low-sided corrugated cardboard cartons, four six-packs to a carton. The carton of six packs is often wrapped with a plastic shrink wrap to hold the six packs in place.

The six cans of a six pack are typically arranged to form a rectangular two-row by three-column array held together with a flexible plastic holder termed a "top grip" which has loops into which the tops of the cans fit. The top grip generally maintains a separation of a few millimeters or so between the top portions of adjacent cans in the six pack.

Although the top grip generally maintains a separation between the top portions of adjacent cans in a six pack, the flexibility of the top grip permits adjacent cans to touch near the bottom of the cans. Touching of adjacent cans gives rise to serious problems in the shipment of six packs of cans. Motion during shipment frequently causes adjacent cans which are touching to rub one another at the points of contact. Such rubbing often wears away the graphics or labelling on the can. The resulting worn spots on the cans are unsightly and reduce the appeal of the product to potential customers. Moreover, adjacent cans which touch can rub one another to such an extent that a wall of one of the cans wears completely through during shipment. When the wall of a can wears through, liquid in the can leaks out. Even a single can which leaks in a shipment of cans of beverage represents a serious loss, since health codes often require that an entire shipment be scrapped even if any leakage occurs.

Recently, an economical spacer tray for containers such as cans or bottles has been developed which effectively maintains a proper spacing between lower portions of cans or other containers loaded in the tray. The new spacer tray is disclosed in U.S. patent application Ser. No. 048,437, filed May 9, 1987 ("the '437 application"), which application is hereby incorporated by reference in the present application. The '437 application should be consulted for details concerning various embodiments of the spacer tray. Two preferred embodiments of the spacer tray which may be used in the loading machine of the present invention are described briefly in the following paragraphs.

Broadly, a first preferred embodiment of the spacer tray is adapted to be used with four six-packs of cans and will be termed the "six-pack spacer tray" below. The six-pack spacer tray is formed of a moldable plastic sheet material and is shaped to provide twenty-four can-bottom receptacles disposed in a four-row by six-column array. Each can-bottom receptacle is shaped to receive at least a part of a bottom portion of a can. A can-spacer wall is located between each pair of adjacent can-bottom receptacles to maintain the bottom portions of the cans seated in the adjacent can-bottom receptacles spaced apart from one another. Fifteen can-loading-guide-pin caps are formed in the spacer tray in a three-by-five array. Each can-loading-guide-pin cap is located centrally of four can-bottom receptacles whose locations are defined by the intersection of a pair of adjacent rows of receptacles with a pair of adjacent columns of receptacles. Each can-loading-guide-pin cap projects generally upwardly from an upper side of the spacer tray and, as explained in more detail below, is shaped to guide bottom portions of cans into the can-bottom receptacles during loading of the spacer tray. The spacer trays are shaped to nest one inside the other to form stacks of nested spacer trays. Four six packs of cans can be loaded in the spacer tray with the bottom portions of the cans seated in the twenty-four can-bottom receptacles of the spacer tray. The can-bottom receptacles around the perimeter of the six-pack spacer tray surround only partially the bottom portions of cans seated in the receptacles. The six-pack spacer tray is dimensioned so that the cans in the can-bottom receptacles around the perimeter of the spacer tray extend outwardly of the perimeter.

A second preferred embodiment of the spacer tray is adapted to be used with loose cans, i.e. cans not connected by top grips to form multipacks, and will be termed below the "loose-can spacer tray." The loose-can spacer tray is generally similar to the six-pack spacer tray described above. In particular, the loose-pack spacer tray has twenty-four can-bottom receptacles and fifteen can-loading-guide-pin caps at essentially the same locations as the can-bottom receptacles and can-loading-guide-pin caps of the six-pack spacer tray. However, the over-all lateral dimensions of the loose-can spacer tray are greater than the lateral dimensions of the six-pack spacer tray to permit certain of the can-bottom receptacles around the perimeter of the spacer tray to surround the bottoms of the cans more completely to hold the loose cans in position laterally more securely.

After being loaded with cans at a bottling facility, spacer trays of either the six-pack or the loose-can type are ordinarily enclosed with a heat-shrinkable plastic film which is caused to shrink by heating. The resulting taut shrink-wrap covering holds the cans in the spacer trays.

Commercial bottling operations for soft drinks or other beverages typically produce cans of beverage at an extremely high rate. Measured in terms of twenty-four can case loads, it is not uncommon for bottling operations to produce filled cans at a rate of 60, 80 or even 100 cases per minute. A need exists for a machine to load the spacer trays described above at such high speeds for commercial bottling operations.

The present invention concerns a high-speed loading machine for loading cans, bottles, or other containers into nestable trays such as the spacer trays described in the '437 application cited above. Features and advantages of the present invention will be evident from the following description.

BRIEF DESCRIPTION OF THE DRAWINGS

A preferred embodiment of the invention is described below with reference to the following drawings:

FIG. 11 is a cross-sectional view taken along line 11—11 of FIG. 3.

FIG. 12 is a side view from the perspective of line 12—12 of FIG. 2.

BEST MODE FOR CARRYING OUT THE INVENTION

Figure 1:
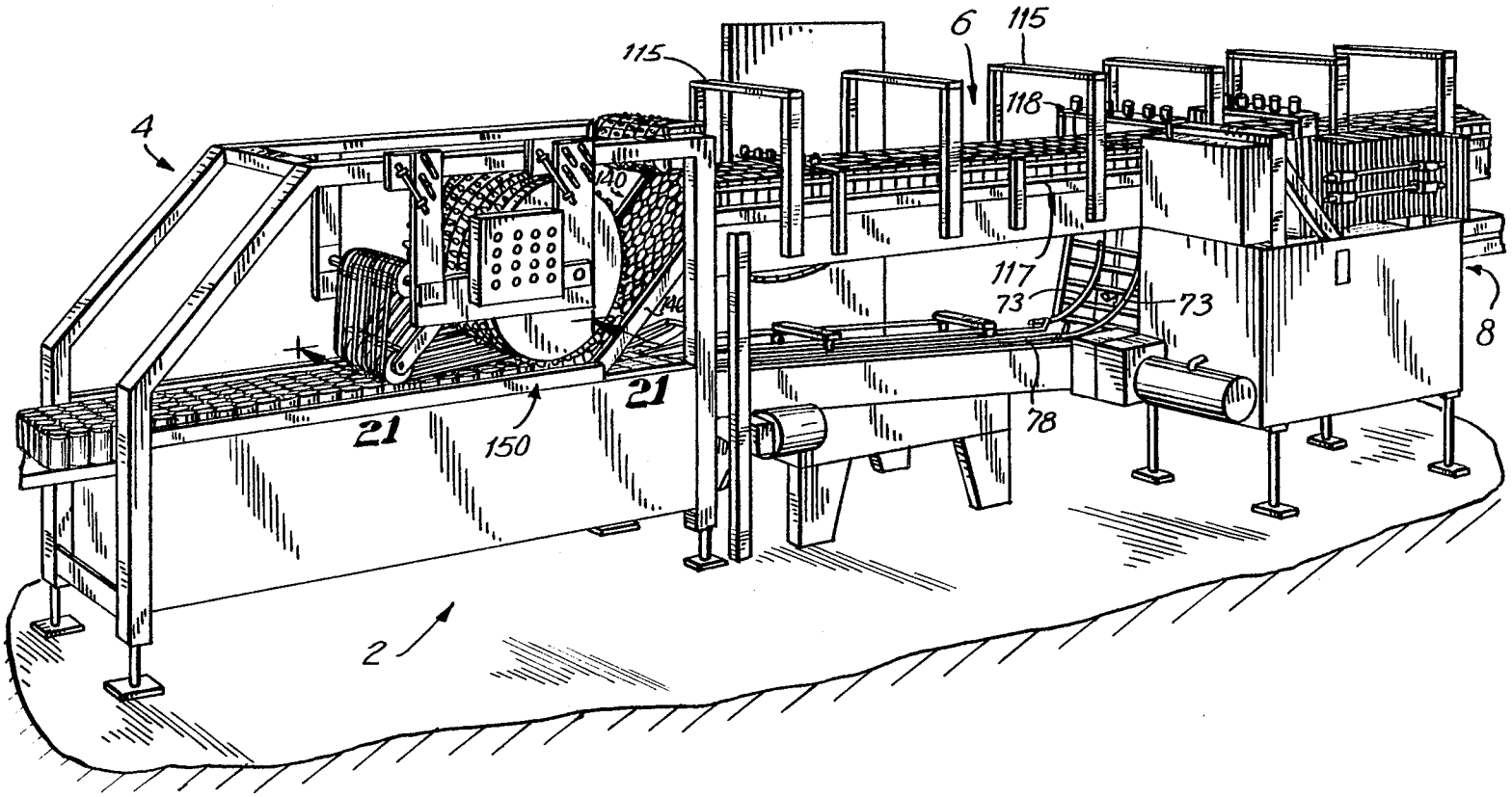
FIG. 1 is a perspective view of a preferred embodiment of the spacer-tray loading machine of the invention.

Referring now to FIG. 1, a spacer-tray loading machine 2 includes a tray loader 4 which is supplied by a six-lane can-supply line 6 and a tray feeder 8. The direction of movement of cans on the can-supply line 6 towards the tray loader 4 defines a direction which is convenient to refer to as the downstream direction. The direction opposite to the downstream direction is referred to as the upstream direction.

Figure 2:
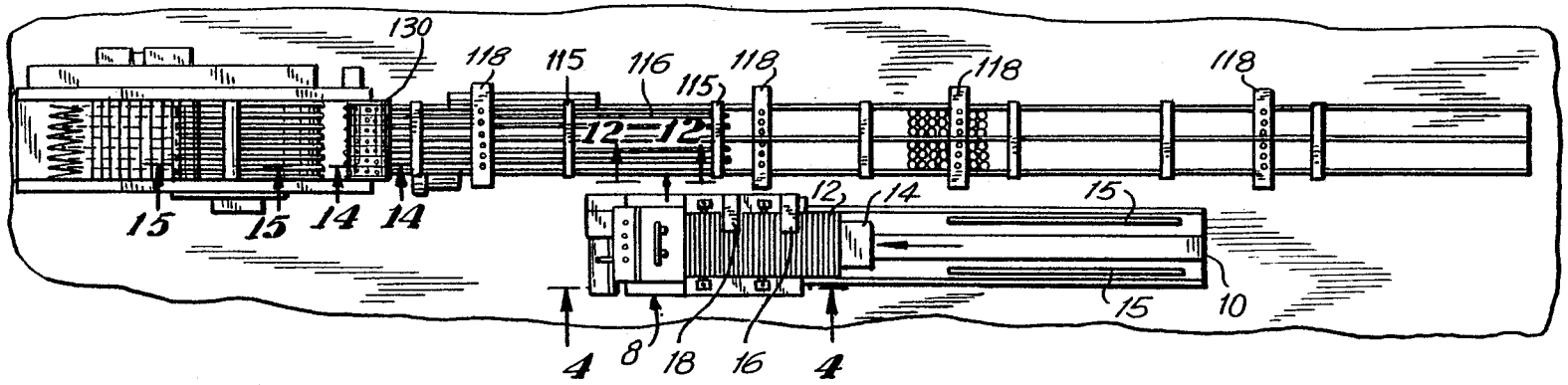
FIG. 2 is a top view of the spacer-tray loading machine of FIG. 1.
Figure 3:
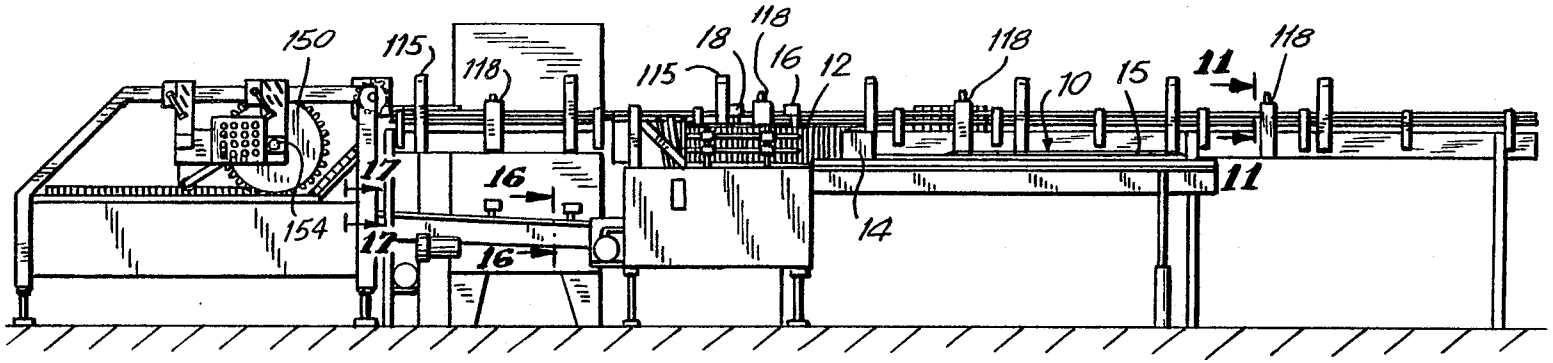
FIG. 3 is a side view of the spacer tray loading machine of FIG. 1.

The tray feeder 8 receives spacer trays from a stacked-tray supply conveyor 10 which extends generally horizontally from the tray feeder approximately parallel to and at roughly the same level as the can-supply line 6, as may be seen in FIGS. 2 and 3. The spacer trays are arranged on the stacked-tray supply conveyor 10 in a nested stack 12 which extends generally horizontally with the spacer trays in the stack long-edge down and—as shown best in FIG. 4—with the can—loading—guide—pin caps 58 of the spacer trays projecting towards the tray feeder 8 in the downstream direction.

A tray-stack pusher box 14 rides on the stacked-tray supply conveyor 10 in contact with an upstream end of the stack 12 to urge the stack towards the tray feeder 8 by means of the motion of the conveyor 10. Along tray-contact lengths of the stacked-tray supply conveyor 10, lower edge portions of the stacked trays contact the belt of the conveyor 10. Forward motion of the belt of the stacked-tray supply conveyor 10 tends to urge the stack 12 of spacer trays towards the tray feeder 8 by means of the contact with the moving conveyor belt by the lower-edge portions of the spacer trays along the tray-contact lengths of the conveyor 10. A pair of tray-lift-rails 15 extend on either side of the belt of the stacked-tray supply conveyor 10 along a tray-override length of the conveyor to raise the lower edges of the stack 12 of spacer trays just above the belt of the conveyor 10 so that the lower edges do not make contact with the moving belt. The interaction of the stack 12 of spacer trays with the tray-contact lengths of the stacked-tray conveyor 10, the tray-override length of the conveyor 10, and the tray-stack pusher box 14 tends to maintain the pressure on the trays at the downstream end of the stack 12 roughly constant, independent of the length of the stack 12.

A tray-supply-low detector 16 is located upstream of the tray feeder 8 along the stacked-tray supply conveyor 10. The tray-supply-low detector 16 comprises a photo cell and a light-beam source disposed above and below the stack 12 on the stacked-tray supply conveyor 10 which detects when the upstream end of the tray stack 12 passes the detector 16. The tray-supply-low detector 16 activates an audible alarm when the end of the stack 12 of trays passes the detector 16 to notify the operator to add additional spacer trays to the stack of trays on the stacked-tray supply conveyor 10.

A tray-supply-depleted detector 18 is located downstream of the tray-supply-low detector 16 and just upstream of the tray feeder 8. The tray-supply-depleted detector 18 comprises a light-beam source and a photocell disposed above and below the stack 12 on the stack 12 on the stacked-tray supply conveyor 10 which detects the passing of the upstream end of the stack 12 of the spacer trays. When the upstream end of the stack of spacer trays passes the tray-supply-depleted detector 18, the spacer tray loading machine 2 is shut down to await the placement of additional spacer trays on the stacked-tray supply conveyor 10. By shutting down the spacer-tray loading machine 2 upon activation of the tray-supply-depleted detector 18, the spacer-tray loading machine 2 remains primed with spacer trays while awaiting an additional supply of spacer trays.

Figure 4:
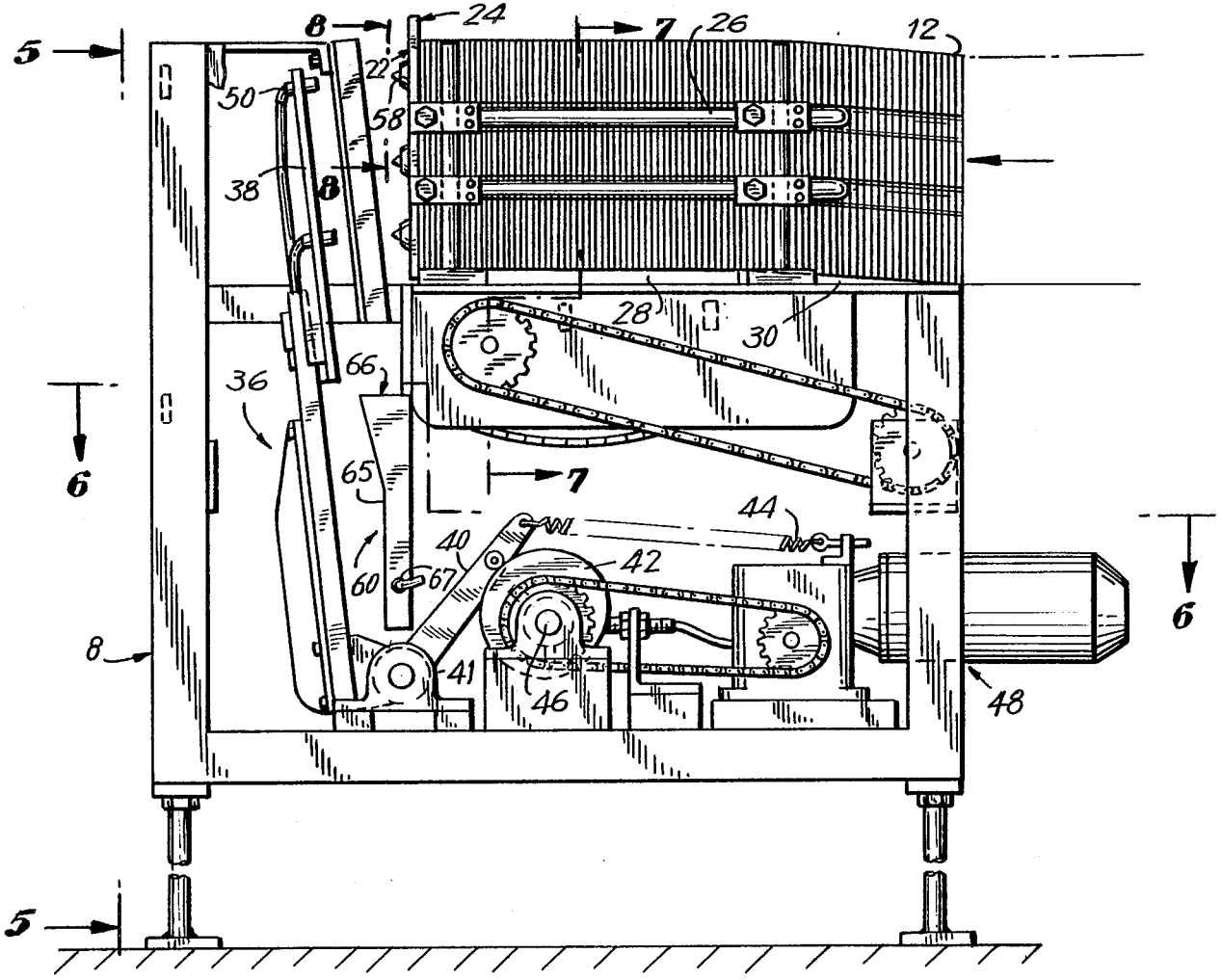
FIG. 4 is a cross-sectional view taken along line 4—4 of FIG. 2.
Figure 7:
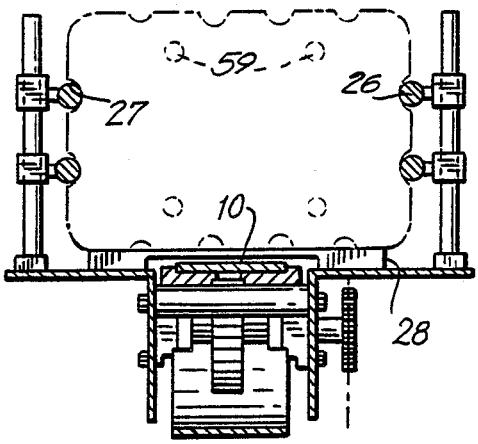
FIG. 7 is a cross-sectional view taken along line 7—7 of FIG. 4.

Turning now to FIG. 4, a downstream end 22 of the stack 12 of spacer trays is urged against a tray-stack retainer assembly 24. Two pairs of tray-stack guide rods 26 are mounted on opposing sides of the stacked-tray supply conveyor 10 and extend generally parallel to the conveyor. As shown best in FIGS. 4 and 7, the four tray-stack guide rods 26 are positioned and dimensioned to engage four short-side cutouts 27 in the short sides of the spacer trays of the stack 12 to guide the trays as they advance towards the downstream end 22 of the stack. The positions of the four short-side cutouts 27 are essentially the same relative to the center of the spacer tray for both six-pack spacer trays and loose-can spacer trays. Thus, the positions of the four tray-stack guide rods 26 do not have to be changed when changing the spacer-tray loading machine 2 from operation with six-pack spacer trays to operation with loose-can spacer trays, or vice versa.

A removable six-pack-spacer-tray support platform 28 is located above the stacked-tray supply conveyor 10 at the downstream end of the conveyor to support spacer trays of the six-pack type. The six-pack-spacer tray support platform 28 has a stack lift ramp 30 at an upstream end of the platform to raise a stack of spacer trays of the six-pack type gradually to bring the short-side cutouts 27 of the trays into alignment with the tray-stack guide rods 26. When loose-can spacer trays—which have a greater short-side dimension than the six-pack spacer trays—are used, the six-pack-spacer-tray support platform 28 can be removed and the stack of loose-can spacer trays supported directly on the stacked-tray supply conveyor 10.

Figure 8:
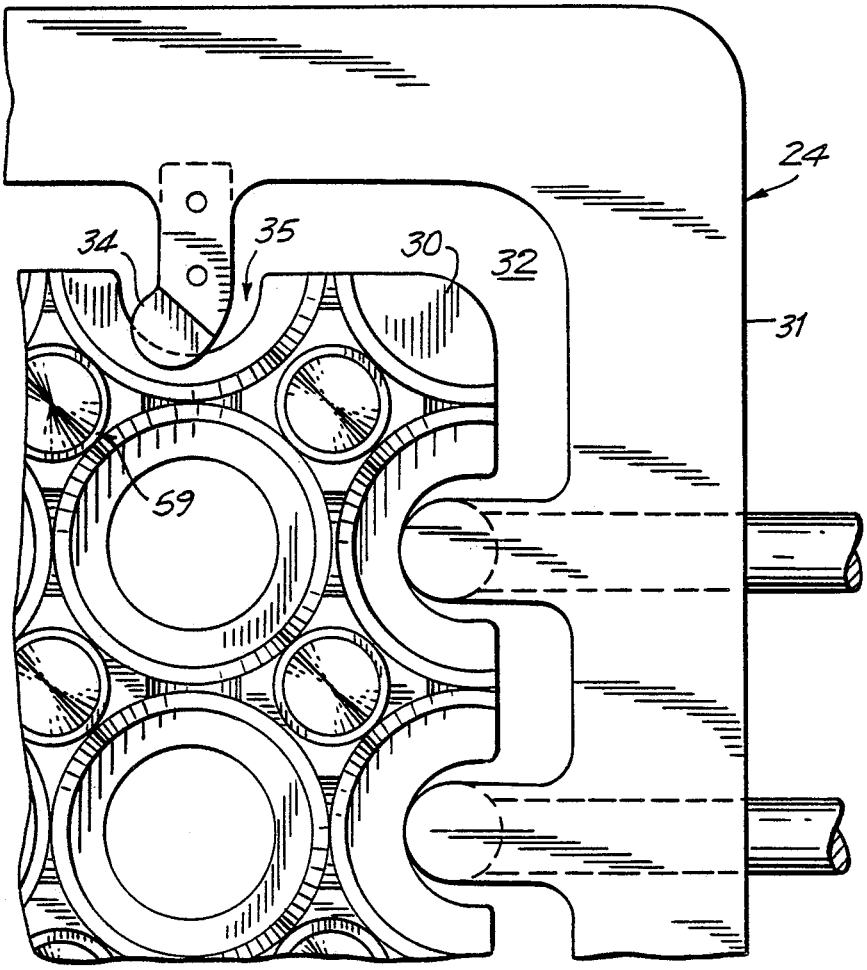
FIG. 8 cut-away, cross-sectional view taken along line 8—8 of FIG. 4.

As shown in FIG. 8, a first spacer tray 30 at the downstream end 22 of the stack 12 is urged towards the tray-stack retainer assembly 24. The tray-stack retainer assembly 24 has a retainer frame 31 through which passes a spacer-tray pull-through opening 32. The spacer-tray pull-through opening is dimensioned to permit the larger-lateral-dimensioned loose-can spacer trays to pass through as well as the smaller-lateral-dimensioned six-pack spacer trays. Four retainer blades 34 (only one of which is shown in FIG. 8) are mounted on the retainer frame 31 to engage edge portions of four long-side retainer cutouts 35 located on opposing long edges of the spacer trays. The positions of the four long-side retainer cutouts 35 are the same relative to the center of the spacer tray for both spacer trays of the six-pack type and spacer trays of the loose-can type. Thus the same tray-stack retainer assembly 24 may be used with spacer trays of either type.

The four retainer blades 34 of the retainer assembly 24 are made of a spring stainless steel roughly 0.031 inch (0.79 mm) thick. The flexibility of the spring steel retainer blades 34 and the flexibility of the plastic sheet material of which the spacer tray is made cooperate to permit the first spacer tray 30 to be pulled face-forward through the spacer-tray pull-through opening 32 in the retainer frame 31. After the first spacer tray 30 is pulled through the spacer-tray pull-through opening 31, the retainer blades 34 engage and retain the next upstream spacer tray in the stack 12.

Turning again to FIG. 4, a pull-and-drop assembly 36 includes a pull-and-drop arm 38 rigidly connected to an oscillator cam follower 40. The pull-and-drop arm 38 and oscillator cam follower 40 are pivotally connected to a housing of the tray feeder 8 by a pivot bearing 41. The oscillator cam follower 40 is urged against a rotatable eccentric cam 42 by a cam-follower spring 44. The eccentric cam 42 is connected to a tray-feeder timing shaft 46, which is rotated by a timing-shaft drive assembly 48. The eccentric cam 42 is shaped so that as the tray-feeder timing shaft 46 rotates, the pull-and-drop arm 38 of the pull-and-drop assembly 36 pivotally oscillates between an essentially-vertical tray-contact orientation (not shown) and a tray-drop orientation (shown in FIG. 4) inclined away from the tray-stack retainer assembly 24.

Figure 5:
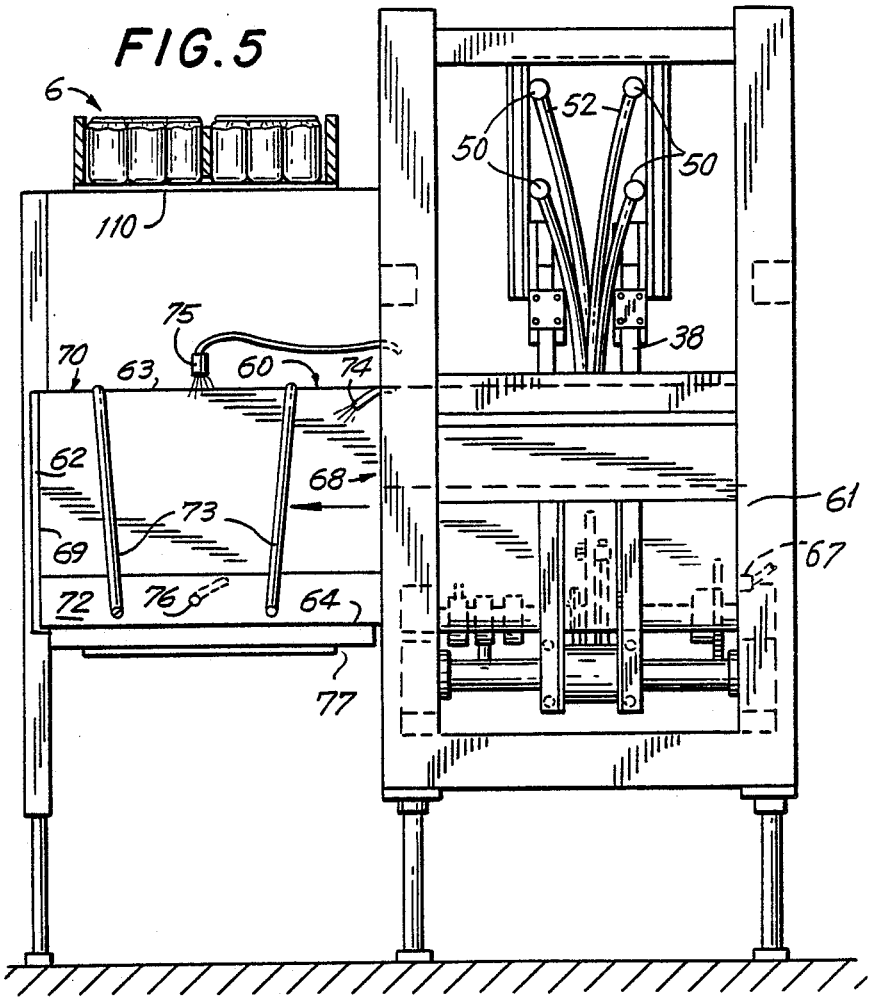
FIG. 5 is a cross-sectional view taken along line 5—5 of FIG. 4.
Figure 9:
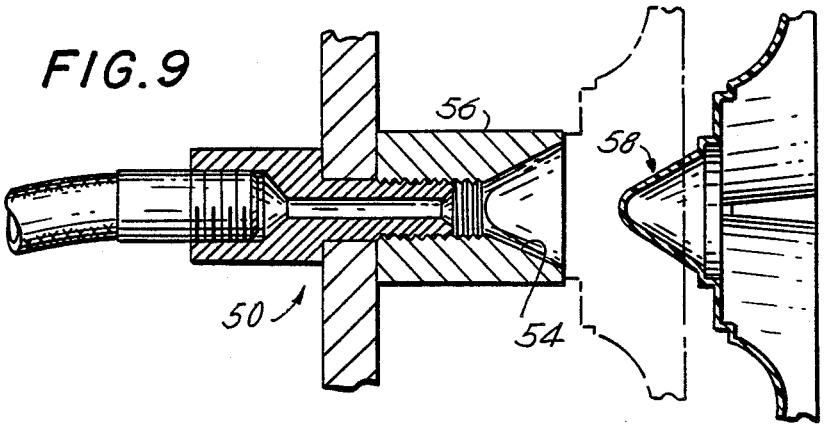
FIG. 9 is a cross-sectional view of a pull-and-drop sucker.

As may be seen in FIGS. 4 and 5, four pull-and-drop suckers 50 are mounted on an upper end of the pull-and-drop arm 38. The four pull-and-drop suckers 50 are connected in common to an electrically-controllable on/off sucker vacuum supply by four air-tight vacuum lines 52. The sucker vacuum supply is capable of pulling a vacuum of roughly 20 inches of mercury. Referring to FIG. 9, each pull-and-drop sucker 50 has a cap puller 56 at an end of the sucker made of a resilient rubber material. The cap puller 56 of the pull-and-drop sucker 50 has a cap-receiver opening 54 formed in it which has a shape approximately complementary to the shape of the can-loading-guide-pin cap 58 of a spacer tray. Application of a vacuum to the pull-and-drop sucker 50 by way of the vacuum line 52 causes a can-loading-guide-pin cap 58 to be held by suction in the cap-receiver opening 54 of the cap puller 56.

The four pull-and-drop suckers 50 are located on the pull-and-drop arm 38 at positions such that when the pull-and-drop arm 38 is in the tray-contact orientation, the cap-puller 56 of each of the four pull-and-drop suckers 50 contacts one of four tray-pull can-loading-guide-pin caps 59 of the first spacer tray 30 retained by the tray-stack retainer assembly 24. All of the can-loading-guide-pin caps 58—including the four tray-pull can-loading-guide-pin caps 59—have essentially the same locations relative to the center of the spacer tray for spacer trays of either the six-pack type or the loose-can type. Thus the locations of the four pull-and-drop suckers 50 do not have to be changed when the spacer-tray loading machine is changed from using spacer trays of one type or the other.

As may be seen in FIG. 5, a tray-shift guide 60 extends generally transverse to the downstream direction defined with respect to the can supply line 6 from a tray-launch end 61 located generally below the tray-stack retainer assembly 24 to a tray-stop end 62 located generally below the can supply line 6. The tray-shift guide 60 includes a tray-shift-guide back 63 which extends transversly along an upstream side of the guide for the length of the guide and a tray-shift-guide floor 64 which extends transversly along the base of the guide for the length of the guide.

Figure 6:
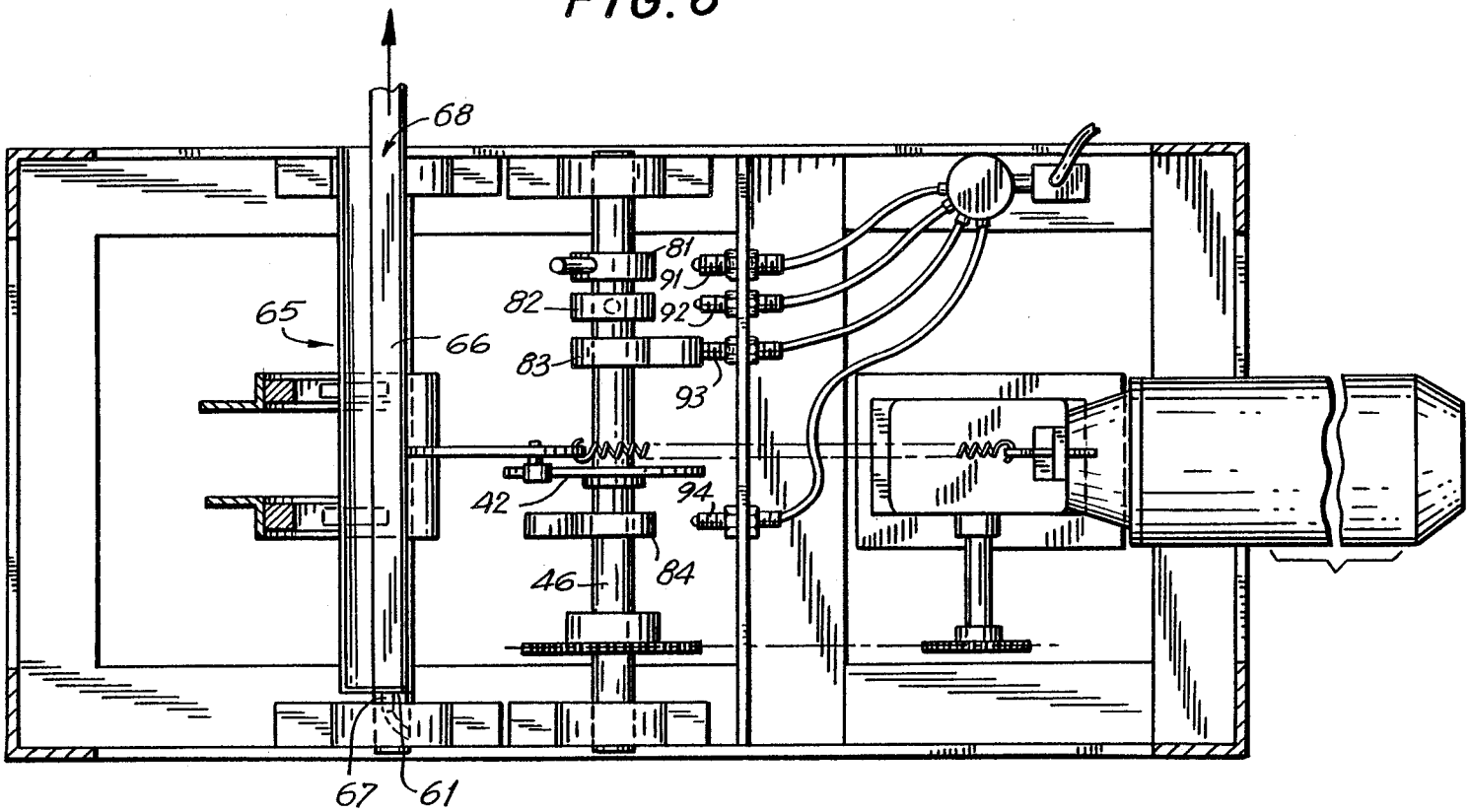
FIG. 6 is a cross-sectional view taken along line 6—6 of FIG. 4.

As shown in FIG. 4, the tray-shift guide 60 has a tray-drop receiver 65 located below and generally offset in a downstream direction from the tray-stack retainer assembly 24. As shown best in FIG. 6, the tray-drop receiver 65 has an elongated tray-drop-receiver opening 66 extending along the top of the receiver. The tray-drop receiver 65 is positioned so that a spacer tray pulled from the end of the stack 12 of spacer trays and held by suction with the pull-and-drop suckers 50 of the pull-and-drop arm 38 can be dropped into the tray-drop receiver 65 by release of the suction when the spacer tray is positioned over the tray-drop-receiver opening 66. A tray-shift transverse-jet air-blast nozzle 67 is mounted in the tray-launch end 61 of the tray-drop receiver 65 and is oriented to direct a blast of air transversely to the downstream direction towards the tray-stop end 62 of the tray-shift guide 60. An opposing end of the tray-drop receiver 65 opposing the tray-launch end 61 is open to define a tray-shift eject opening 68. A tray-shift stop 69 is formed in the tray-stop end 62 of the tray-shift guide 60. The tray-shift eject opening 68 permits a spacer tray to pass from the tray-drop receiver 65 to the tray-shift stop 69.

As may be seen best in FIG. 5, a section of the tray-shift guide 60 located generally below the can supply line 6 defines a tray-flip ejector 70. A face of the tray-flip ejector 70 facing in the downstream direction is open to define a tray-flip eject opening 71, as shown in FIG. 12. An air-blast gap 72 is formed in a base portion of the tray-shift-guide back 63 in the tray-flip ejector 70. A pair of curved tray-flip guide rods 73 are spaced apart from the tray-flip eject opening 71 of the tray-shift guide 60 in a generally downstream direction. As may be seen best in FIG. 1, the tray-flip guide rods 73 extend in a generally arcuate manner from a position near the top of the tray-flip ejector 70 to a position spaced well away from the ejector at a lower level of the ejector.

A tray-shift oblique-jet air-blast nozzle 74 is located proximate to an upper portion of the tray-shift eject opening 68 spaced generally downstream of the tray-flip opening 68. The tray-shift oblique-jet air-blast nozzle 74 is oriented to direct a blast of air in a generally transverse, upstream, downward direction to tend to propel a spacer tray passing through the tray-shift eject opening 68 from the tray-drop receiver 65 towards the tray-stop end 62 of the tray-shift guide 60, and—once the spacer tray reaches the tray stop 69—to tend to urge the spacer tray simultaneously against the tray stop 69, the tray-shift-guide back 63, and the tray-shift-guide floor 64. The tray-shift oblique-jet air-blast nozzle 74 and the tray-shift transverse-jet air-blast nozzle 67 are connected in common to an electrically-controllable tray-shift pressurized air source (not shown).

A tray-flip down-jet air-blast nozzle 75 is located above the tray-flip ejector 70 of the tray-shift guide 60. The tray-flip down-jet air-blast nozzle 75 is oriented to direct a blast of air into the tray-flip ejector 70 in a downward direction. Positioned behind the air-blast gap 72 in the tray-shift-guide back 63 at the tray-flip ejector 70 is a tray-flip downstream-jet air-blast nozzle 76. The tray-flip downstream-jet air-blast nozzle 76 is oriented to direct a blast of air in a generally downstream direction through the air-blast gap 72. The tray-flip down-jet air-blast nozzle 75 and the tray-flip downstream-jet air-blast nozzle 76 are connected in common to an electrically-controllable tray-flip pressurized air source (not shown). Each of the four air-blast nozzles 67, 74, 75 and 76 are a spray nozzle commercially available from Spraying Systems Company. Each of the tray-shift and tray-flip pressurized air sources produces pressurized air at a pressure of about 80 psig.

As shown in FIGS. 5 and 12, a tray-feed-queue conveyor 77 passes centrally under the tray-flip ejector 70 of the tray feeder 8 and extends to the tray loader 4 for transporting spacer trays in substantially the downstream direction from the tray feeder to the tray loader. Simultaneous blasts of air from the tray-flip down-jet air-blast nozzle 7 and the tray-flip downstream-jet air-blast nozzle 76 cause a spacer tray in the tray-flip ejector 70 resting against the tray stop 69 and the tray-shift-guide back 63 with a long side resting on the tray-shift-guide floor 64 to be ejected from the tray-flip opening 71 and to rotate about a generally transverse horizontal axis from an approximately vertical orientation to an approximately horizontal orientation, as shown in FIG. 12. The tray-flip guide rods 73 assist in changing the orientation of the spacer tray from approximately vertical to approximately horizontal. The spacer tray ejected from the tray-flip ejector 70 comes to rest on the tray-feed-queue conveyor 77 with the long side of the spacer tray extending essentially crosswise to the downstream direction.

Figure 16:
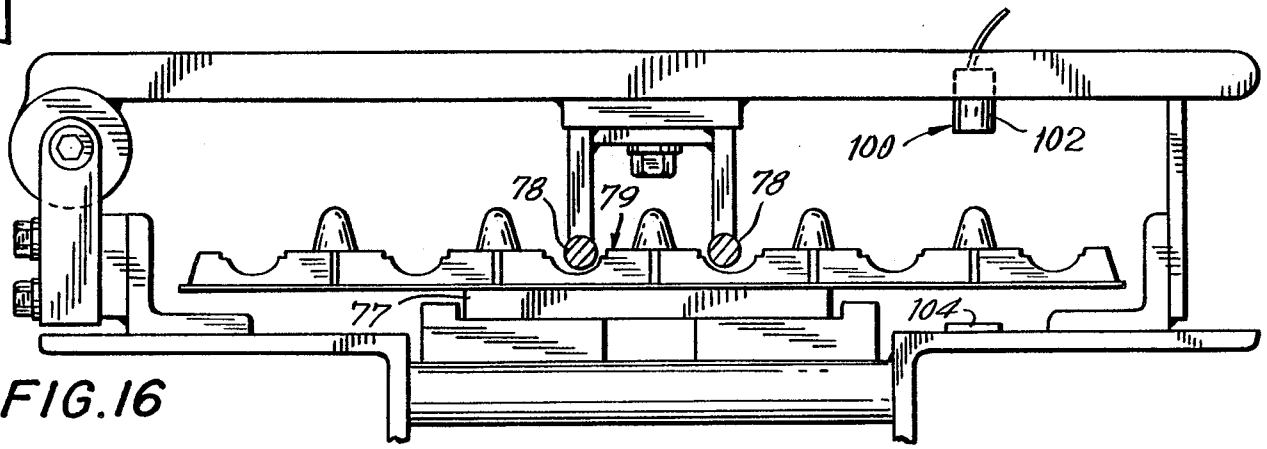
FIG. 16 is a cross-sectional view taken along line 16—16 of FIG. 3.

A pair of generally parallel tray-feed-queue guide rods 78 extend above the tray-feed-queue conveyor 77. The tray-feed-queue guide rods 78 are positioned to engage a central row of three can-loading-guide structures 79 on a spacer tray being carried by the tray-feed-queue conveyor 77—as shown in FIG. 16—to guide the spacer tray. The spacer tray can-loading guide structures 79 engaged by the tray-feed-queue guide rods 78 have essentially the same dimensions for spacer trays of the six-pack type and the loose-can type. Thus the tray-feed-queue guide rods 78 do not have to be repositioned when the spacer-tray loading machine 2 is changed from using spacer trays of one type to the other.

Downstream of the tray-flip ejector 70 along the tray-feed-queue conveyor 77 is a tray-feed-queue-full detector 100. The tray-feed-queue-full dector 100 includes a photocell/light source 102 mounted above the level of the tray-feed-queue conveyor 77 and a reflector 104 mounted below the level of the conveyor, so that passage of a spacer tray along the conveyor interrupts the light beam and is detected by the photocell. The tray-feed-queue-full detector 100 includes a timed-delay signal-suppression circuit which causes the detector to ignore interruptions in the light beam for time intervals corresponding to the length of time a spacer tray being normally carried on the tray-feed-queue conveyor 77 interrupts the light beam. Interruptions of the light beam for longer time intervals causes the tray-feed-queue-full detector 100 to signal that the tray feed queue is full. The tray-feed-queue detector 100 is connected to the vacuum source, the tray-shift pressurized air supply and the tray-flip pressurized air supply of the tray feeder 8. When the tray-feed-queue-full detector 100 detects that spacer trays are queued up on the tray-feed-queue conveyor 77 back to the position of the tray-feed-queue-full detector 100, the vacuum and pressurized air supplies of the tray feeder 8 are disabled to prevent further trays from being withdrawn from the stack 12 of spacer trays and placed on the conveyor.

As explained in more detail below, the pull-and-drop arm 38 is adapted to pivot towards the tray-stack retainer assembly 24 to bring the cap pullers 56 of the pull-and-drop suckers 50 into contact with the spacer tray retained by the retainer assembly, to engage the four tray-pull can-loading-guide-pin caps 59 of the tray by suction, to pivot back away from the tray-stack retainer assembly 24 to pull the tray through the spacer-tray pull-through opening 32 the assembly, and to drop the spacer tray in the tray-drop receiver 61 by release of the suction.

Figure 26:
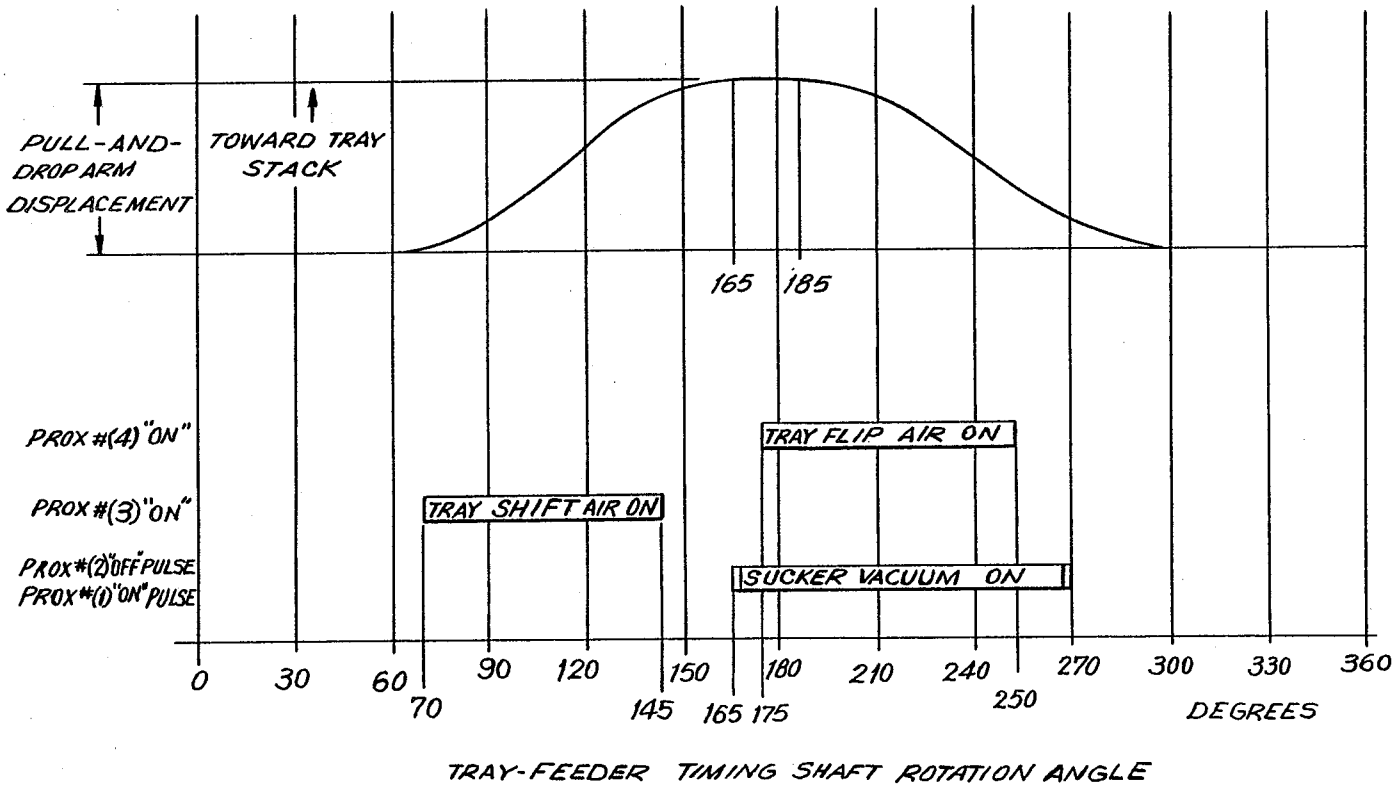
FIG. 26 is a timing diagram for the operation of the spacer-tray feeder of the spacer-tray loading machine of FIG. 1.

Turning again to FIG. 6, the tray-feeder timing shaft 46 has four timing wheels mounted on it: (1) a vacuum-on timing wheel 81; (2) a vacuum-off timing wheel 82; (3) a tray-shift pressurized-air-supply timing wheel 83; and (4) a tray-flip pressurized-air-supply timing wheel 84. Each of the four timing wheels has a proximity-switch-trip projection extending radially from it over an arcuate portion of the wheel. Each of four proximity switches 91 through 94 is associated respectively with one of the four timing wheels 81 through 84: (1) a vacuum-on proximity switch 91; (2) a vacuum-off proximity switch 92; (3) a tray-shift pressurized air-supply proximity switch 93; and (4) a tray-flip pressurized-air-supply proximity switch 94. Each proximity switch is positioned so that the proximity-switch-trip projection of the associated timing wheel passes sufficiently close to the proximity switch for the switch to detect the presence of the projection. Rotation of the tray-feeder timing-shaft 46 causes the four timing wheels 81 through 84 to rotate in synchronism with the eccentric cam 42, and thus causes the four proximity switches 91 through 94 to be switched on and off in synchronism with the oscillation of the pull-and-drop arm 38. Vacuum on and off proximity switches 91 and 92 switch the sucker vacuum supply on and off respectively. When the tray-shift pressurized-air supply proximity switch 93 is in an "on" or "off" state, the electrically-controllable tray-shift pressurized air supply is on or off respectively, causing the tray-shift transverse-jet air-blast nozzle 67 and the tray-shift oblique-jet air-blast nozzle 74 to be activated or not as the case may be. When the tray-flip pressurized air supply proximity switch 94 is in an "on" or "off" state, the tray-flip pressurized air supply is respectively on or off, causing the tray-flip down-jet air blast nozzle 75 and the tray-flip downstream-jet air-blast nozzle 76 to be activated or not. Thus rotation of the tray-feeder timing shaft 46 determines the sequence of spacer-tray pulling (sucker vacuum on), dropping (sucker vacuum off), shifting (tray-shift pressurized air supply on) and flipping (tray-flip pressurized air supply on) performed by the tray feeder 8. The timing of the four timing wheels 81 through 84 is shown in FIG. 26 and the displacement of the pick-off arm 38 as a function of the angle of rotation of the tray-feeder timing-shaft 46.

Figure 10:
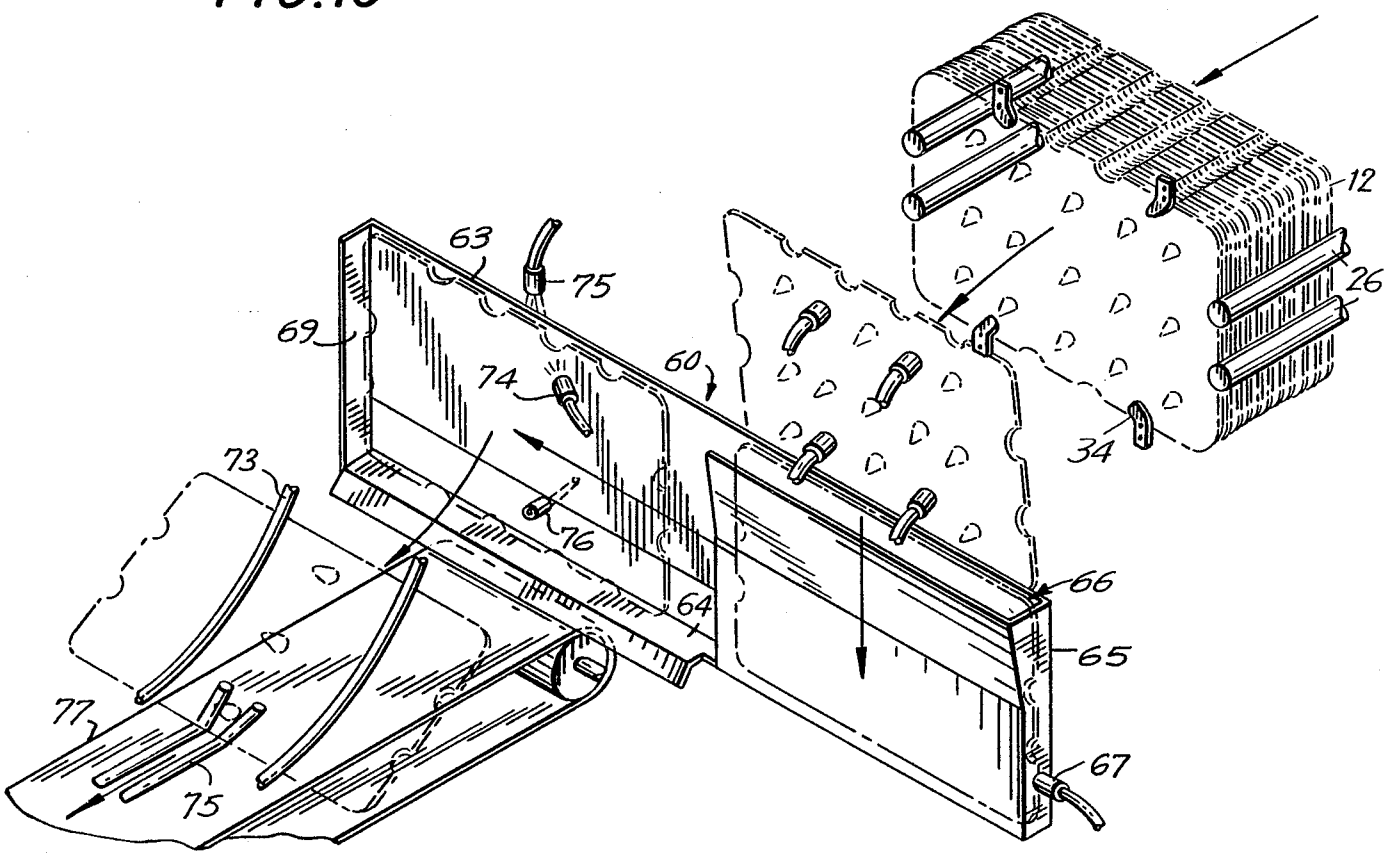
FIG. 10 is a schematic perspective view illustrating the operation of a spacer-tray feeder of the spacer-tray loading machine of FIG. 1.

Operation of the tray feeder is illustrated schematically in FIG. 10. The nested stack 12 of spacer trays is urged towards the tray-retainer blades 34 which engage the first spacer tray 30 in the downstream end of the stack 12. The pull-and-drop arm 38 pivots forward to the tray-contact orientation, bringing the four pull-and-drop suckers 50 into contact with four tray-pull can-loading-guide pin caps 59 on the spacer tray 30. As the four pull-and-drop suckers 50 come into contact with the tray-pull caps 59, the vacuum-on proximity switch 91 detects the presence of the proximity-switch-trip projection of the vacuum-on timing wheel 81 and activates the sucker vacuum supply, so that a vacuum is applied to the four pull-and-drop suckers 50. The four can-loading-guide-pin caps 59 within the pull-and-drop suckers are thus retained by suction. As the pull-and-drop arm 38 pulls away from the downstream end of the stack 12 of spacer trays, the first spacer tray 30 is pulled off from the stack, with the spacer tray and the retainer blades 34 deflecting to permit the spacer tray to be pulled past the four retainer blades 34.

When the pull-and-drop arm 38 has pivoted back close to the tray-drop orientation, the proximity-switch-trip projection of the vacuum-off timing wheel 84 passes close to the vacuum-off proximity switch 92, causing the sucker vacuum supply to be turned off. The resulting release of the vacuum from the pull-and-drop suckers 50 causes the spacer tray to drop from the suckers 50. The relative angular orientation of the vacuum-off timing wheel 82 and the eccentric cam 42 results in the pull-and-drop arm 38 to being in a position when the vacuum supply is turned off such that the dropped spacer tray falls into the tray-drop receiver 65 of the tray-shift guide 60.

After the spacer tray falls into the tray-drop receiver 65, the proximity-switch-trip projection of the tray-shift pressurized-air-supply timing wheel 83 rotates into a position to switch on the tray-shift pressurized-air-supply proximity switch 93, which in turn causes the tray-shift pressurized air supply to turn on. As a result, a blast of air is emitted by the tray-shift transverse-jet air-blast nozzle 67 and the transverse-shift oblique-jet air-blast nozzle 74. The blast of air from the tray-shift transverse-jet air-blast nozzle 67 blows the spacer tray in the tray-drop receiver 65 transversly across the tray shift guide 60 to the tray-flip ejector 70. The blast of air from the tray-shift oblique-jet air-blast nozzle 74 causes the spacer tray to be urged against the tray stop 69, the tray-shift-guide back 63 and the tray-shift-guide floor 64 of the tray-shift guide 60.

Continued rotation of the tray-feeder timing shaft 46 causes the tray-shift pressurized-air-supply proximity switch 93 to be switched off as the proximity-switch-trip projection of the tray-shift pressurized air-supply timing wheel 83 rotates past the switch, thus switching off the tray-shift pressurized air supply. The proximity-switch-trip projection of the tray-flip pressurized-air-supply timing wheel 84 then rotates into proximity with the tray-flip pressurized-air-supply proximity switch 94, which turns on the tray-flip pressurized air supply. Turning on the tray-flip pressurized air supply causes blasts of air to be emitted by the tray-flip down-jet air-blast nozzle 75 and by the tray-flip downstream air-blast nozzle 76. Blasts of air from the two tray-flip nozzles 75 and 76 causes the spacer tray to be ejected from the tray-flip ejector 70 onto the tray-feed-queue conveyor 77 and to flip from an approximately vertical orientation to an approximately horizontal orientation.

Continued rotation of the tray feeder timing shaft 46 of the tray feeder 8 causes the cycle of pulling, dropping, shifting, and flipping to be repeated. As may be seen from the timing diagram of FIG. 26, steps of the cycle overlap, so that a first tray is being pulled from the stack while a second tray is being flipped by ejection from the tray-flip ejector 70. As noted above, when the tray-feed-queue-full detector 100 detects that the queue of trays on the tray-feed-queue conveyor 77 is full, the sucker vacuum supply and the tray shift and tray flip pressurized air supplies are disabled. The tray-feeder timing shaft 46 continues to rotate in this event, so that the pull-and-drop arm 38 continues to oscillate, but spacer trays are not advanced through the tray feeder.

Figure 13:
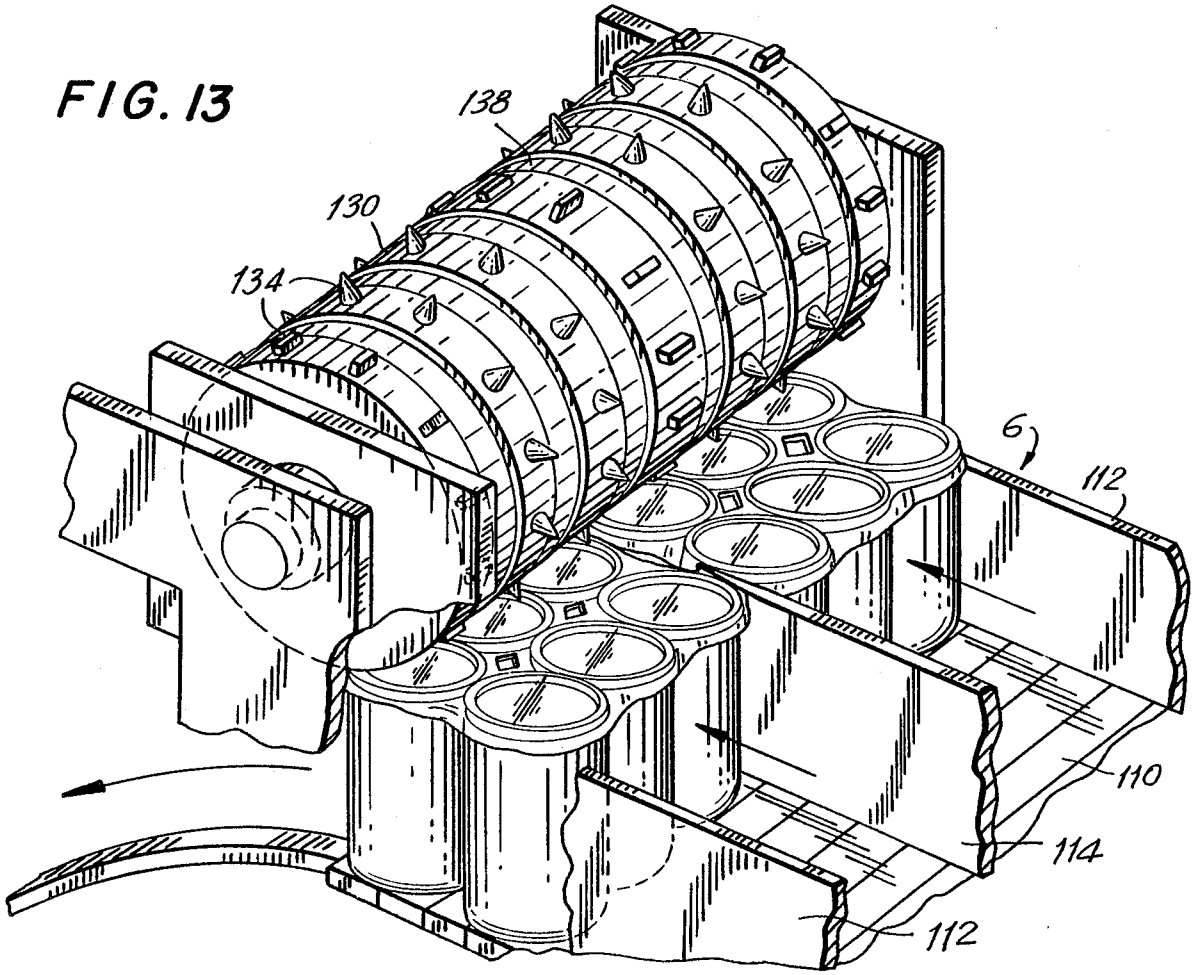
FIG. 13 is a partially-cut-away, perspective view of a pressure relief drum of the spacer-tray loading machine of FIG. 1.

Turning now to FIG. 13, the can supply line 6 has a can transport conveyor 110 which has a transverse dimension sufficient to accommodate six lanes of cans. Cans filled with beverage, for example, are loaded on the can-transport conveyor 110 from a canning line (not shown). Two can-supply-line side walls 112 are laterally-adjustably mounted on opposing sides of the can-transport conveyor 110 with the lower edges of the side walls spaced above the conveyor a conveyor-clearance distance to permit the conveyor to translate beneath the side walls without obstruction. A can-supply-line divider wall 114 extends centrally between the two can-supply-line side walls 112 to divide the can supply line 6 into two six-pack channel ways, each three lanes wide. The can-supply-line divider wall 114 is suspended from can-supply-line support brackets 116 which extend over the can-transport conveyor 110, as shown best in FIG. 1, by divider-wall suspension rods (not shown). The lower edge of the can-supply-line divider wall 114 is spaced above the can-transport conveyor 110 to permit the conveyor to translate beneath the divider wall.

When the tray loading machine 2 is used with loose cans, the can supply line 6 is divided into six can channel ways, each one lane wide, by five can-supply-line divider walls 116. The five can-supply-line divider walls 116 extend between and substantially parallel to the two can-supply-line side walls 112 as shown in FIG. 2. When five can-supply-line divider walls 116 are used, the can-supply-line side walls 112 are spaced laterally further apart than when a single can-supply-line divider wall 114 is used in order to accommodate the additional thickness represented by the four additional divider walls.

The side walls of the can-supply-line side walls 112 and divider walls 114 and 116 which front a channel way are faced with Delrin plastic to minimize abrasion of the cans passing through the channel way. As an alternative to the can-supply-line side walls 112, a twin-rail side barrier 117 can be used, as shown in FIG. 1. The rails of the twin-rail side barrier 117 can be faced with a low-friction plastic such as Delrin to minimize abrasion to the cans.

To detect interruptions in the transport of cans down the can supply line 6, four six-channel can proximity detectors 118 are mounted at intervals over the can supply line, as may be seen in FIGS. 1 and 2. Each six-channel can proximity detector 118 includes six metal proximity switches 120 of a capacitive-effect sensor type commercially available under the trade designation of "Effector Proximity Switch No. 8057-AL20 NL3 NAXX." Each of the metal proximity switches 120 is mounted over a lane of the can supply line 6 with a sensor end of the proximity switch located just above the level of the tops of the cans transported on the can supply line 6, as may be seen in FIG. 11. The six metal proximity switches 120 of each can proximity detector 118 are divided into two groups of three switches in each group. Each group of three metal proximity switches 120 is supported separately by a three-switch support bracket 122 which is cantilevered over three lanes of the can supply line 6. A gap 124 between the two three-switch support brackets 122 permits a central can-supply-line divider wall 114 to be conveniently, inserted or removed.

Figure 25:
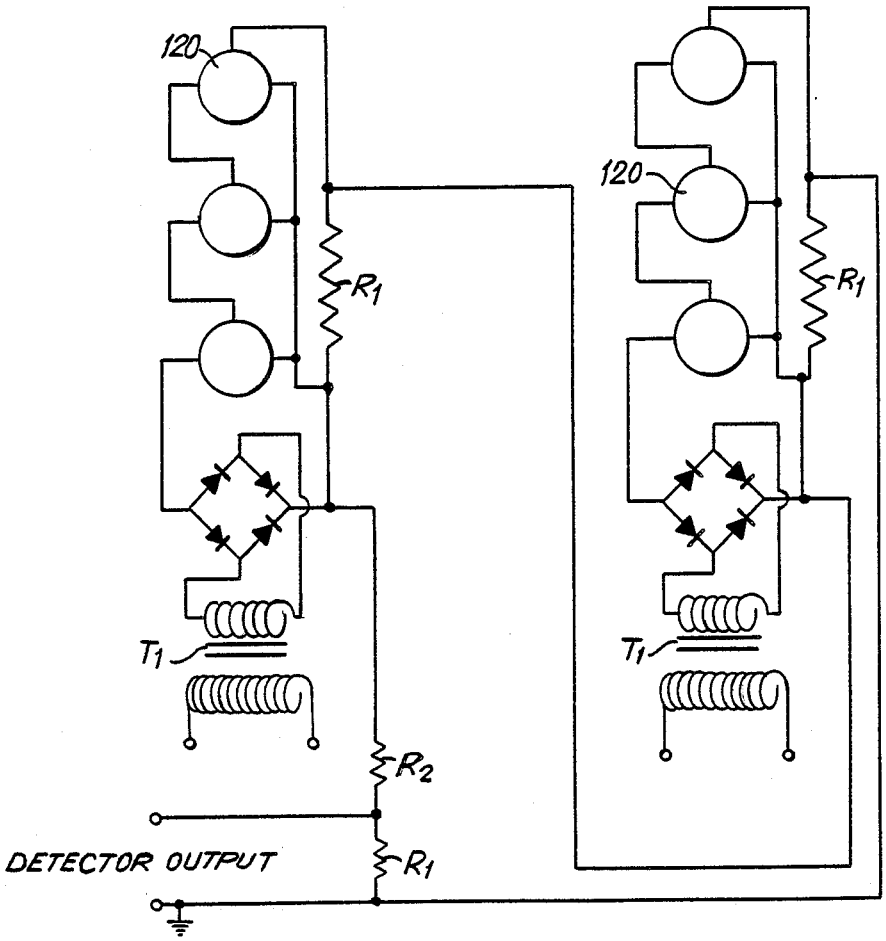
FIG. 25 is a circuit diagram of a six-lane can-proximity detector.

Each group of three metal proximity switches 120 is separately powered through a DC isolation transformer $T_1$ as shown in the circuit diagram for the six-channel canproximity detector 118 provided in FIG. 25. The isolation transformer $T_1$ is a step-down transformer which converts 120 volts AC to 24 volts AC. Resistor $R_1$ in the circuit diagram of FIG. 25 is a 180 ohm, 5 watt resistor and resistor $R_2$ is a 330 ohm, 5 watt resistor. If cans are proximate to all six metal proximity switches 120, a voltage of less than five volts DC appears at the detector output of the six-channel can proximity detector 118 to constitute a "six-lanes-occupied" signal. If one or more of the metal proximity switches fails to detect a can, a voltage of greater than 10 volts DC appears at the detector output to constitute a "lane-empty" signal.

A control circuit for the spacer-tray loading machine 2 is adapted to use the detector output signals from the four six-channel can proximity detectors 118 as follows. If all four can proximity detectors 120 produce six-lanes-occupied signals, the spacer-tray loading machine 2 is enabled for high-speed operation. If the three downstream can proximity detectors 118 produce six-lanes-occupied signals and the upstream-most can proximity detector produces a lane-empty signal, the spacer-tray loading machine 2 is enabled for intermediate-speed operation. If the two downstream-most can proximate detectors 118 produce six-lanes-occupied signals and the next succeeding upstream can proximity detector produces a lane empty signal, the spacer-tray loading machine 2 is enabled for creep speed operation. Finally, if either of the two downstream-most can proximity detectors 118 produces a lane-empty signal, the spacer-tray loading machine 2 is shut down.

Figure 14:
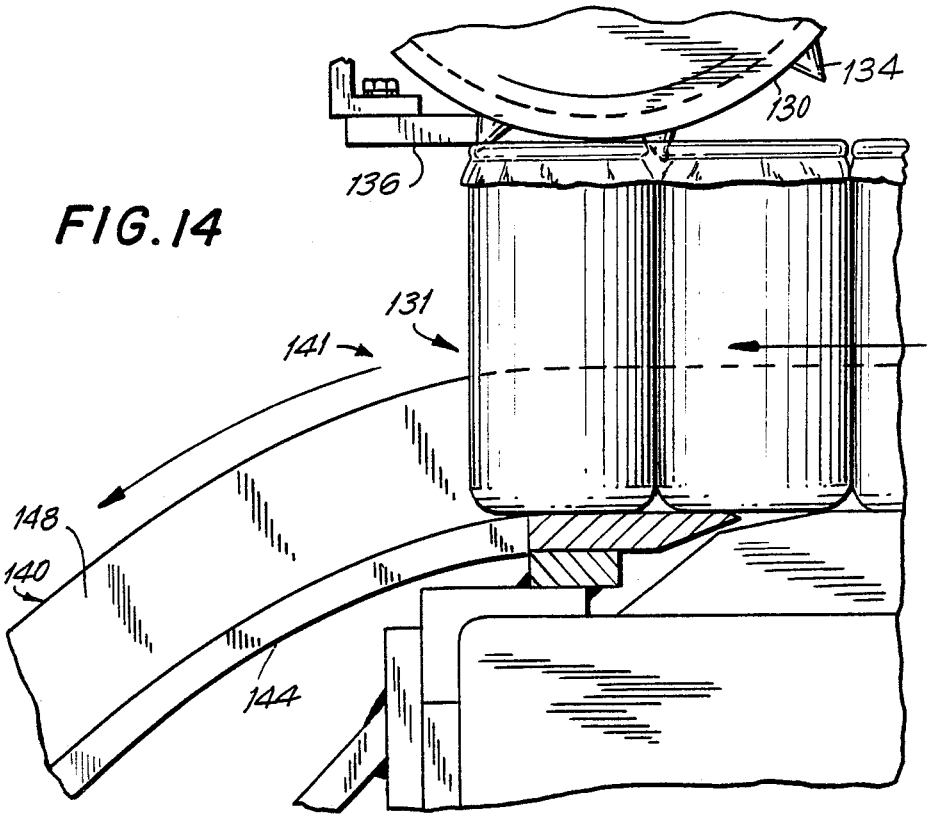
FIG. 14 is a cross-sectional view taken along line 14—14 of FIG. 2.

A can-line pressure-relief drum 130 is located at a downstream end 131 of the can transport conveyor 110 of the can supply line 6. A plurality of can-top engagement projections 134 project radially outwardly from the pressure-relief drum 130. The can-top engagement projections 134 are arranged in seven circumferential bands spaced apart transversely along the pressure-relief drum 130. As shown best in FIG. 14, the can-top engagement projections 134 are shaped and located to fit in gaps between the tops of cans passing under the pressure-relief drum 130 at the downstream end of the can-supply line 6. The can-top engagement projections 134 tend to engage generally downstream facing edge portions of the tops of the cans and exert generally upstream-directed forces to oppose the generally downstream directed pressure transmitted through the cans in the supply line 6 and generated by movement of the can transport conveyor 110 under the cans. The pressure-relief drum 130 is driven in synchronism with the operation of the tray loader 4 by means of a chain drive (not shown). The pressure-relief drum 130 serves to meter the cans off the downstream end 131 of the can supply line 6 at a controlled rate synchronized with the rate at which cans are being loaded into spacer trays by the tray loader 4.

Six can-stripper fingers 136 are mounted centrally of each of the six lanes of cans adjacent to a lower portion of the pressure-relief drum 130 on a downstream side of the drum. Each of the can-stripper fingers 136 has a wedge-shaped end portion which projects into a can-stripper-finger groove 138 which extends circumferentially around the pressure-relief drum 130 between a pair of adjacent rows of can-top engagement projections 134. The can-top stripper fingers 136 serve to prevent cans from riding up with the pressure-relief drum 130 as the drum rotates.

A downwardly-inclined six-lane can-feed-queue ramp 140 extends from a can-supply-line can-discharge location 141 below the pressure-relief drum 130 to a can-intake location 142 in the tray loader 4 of the spacer-tray loading machine 2. Each lane of the can-feed-queue ramp 140 has a curvilinear can-feed-queue support slide 144 which is downwardly inclined to permit cans to slide under the action of gravity from the can-discharge location 141 to the can-intake location 142. The can-feed-queue support slide 144 is made of a phosphor-bronze alloy, which has a low coefficient of friction to permit cans to slide down the can-feed-queue ramp 140 readily. The can-feed-queue ramp 140 includes ramp side walls 146 and ramp divider walls 148 to divide the six lanes of the ramp into two three-lane ramp six-pack channel ways for guiding six packs of cans oriented generally crossways to the ramp or into six one-lane ramp can-channel ways for guiding loose cans. The side walls of the ramp side walls 146 and the ramp divider walls 148 fronting ramp channel ways are faced with Delrin plastic to reduce friction and abrasion of the cans.

As shown in FIGS. 1 and 3, the tray loader 4 of the spacer-tray loading machine includes a can-loading metering wheel 150 connected to a frame of the tray loader 4. The metering wheel 150 includes seven can-metering disks 152 disposed side-by-side in a spaced apart relationship fixedly connected to a rotatable shaft 154. As shown best in FIG. 21, a plurality of can-top locating pins 156 project radially outwardly from the circumference of each can-metering disk 152. Each can metering disk 152 has a radius of about 11.4 inches (about 289 mm) and the can-top locating pins 156 project radially about 1.5 inches (about 38 mm) beyond the circumference of the can-metering disk. As may be seen in FIGS. 21 and 22, end portions of the can-top locating pins 156 are tapered to fit within an opening defined between the tops of four cans which are adjacent to one another. Each pair of azimuthally adjacent can-top locating pins 156 on a can metering disk 152 together with a pair of transversely adjacent can-top locating pins 156 on a next adjacent can-metering disk 152 constitute a group of four can-top locating pins 156 which can receive and tend to locate the top of a can by a four-point mechanical constraint. The shape of the can-top locating pins 156 permits conventional beverage cans with body diameters of the 209 size having lid diameters of any of the 206, 207½ and 209 size to be loaded by the tray loader 4.

Figure 15:
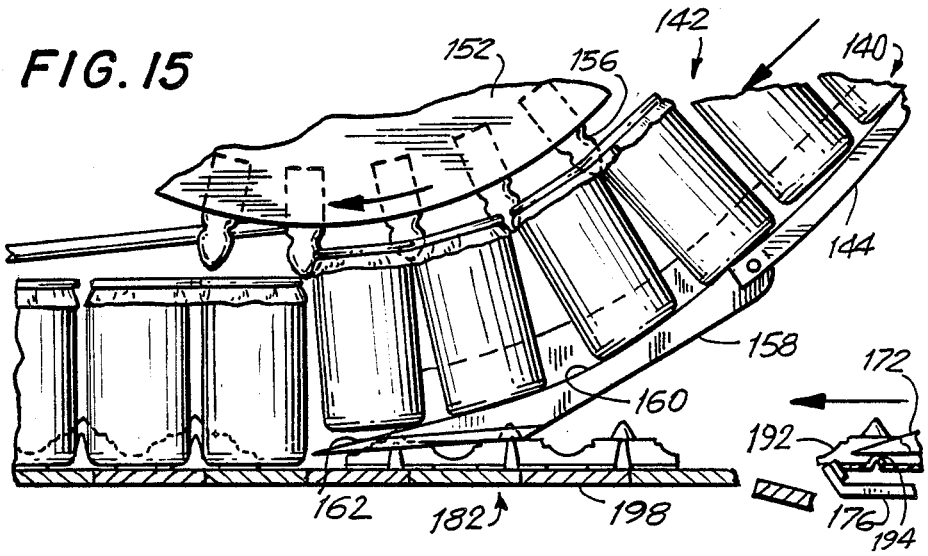
FIG. 15 is a cross-sectional view taken along line 15—15 of FIG. 2.

As may be seen in FIG. 15, cans sliding to the can intake location 142 of the tray loader 4 at the bottom of the can-feed-queue ramp 140 are engaged by the can-top locating pins 156 of the rotating can-loading metering wheel 150. Rotation of the metering wheel 150 causes the cans to be advanced under the wheel in synchronism with the rotation of the wheel. A lower end of the can-feed-queue support slide 144 is curved in the direction of the curvature of the circumference of the can-loading metering wheel 150. A slide-extension finger 158 is pivotally attached to the lower end of the can-feed-queue support slide 144. An end portion of the slide extension finger adjacent to the support slide is shaped to have an arcuate upper surface 160 which has a center of curvature located approximately on the centerline of the can-loading metering wheel 150. An opposing end portion of the slide-extension finger 158 is shaped to form a downwardly inclined ramp 162. Lower portions of adjacent cans being advanced across the arcuate upper surface 160 of the slide-extension finger 158 by the can-loading metering wheel 150 tend to spread apart from one another because of the curvature of the surface. A separation between such adjacent cans tends to be maintained as the cans pass over the downwardly inclined ramp 162 of the slide extension finger 158 to meet with a space tray.

Figure 20:
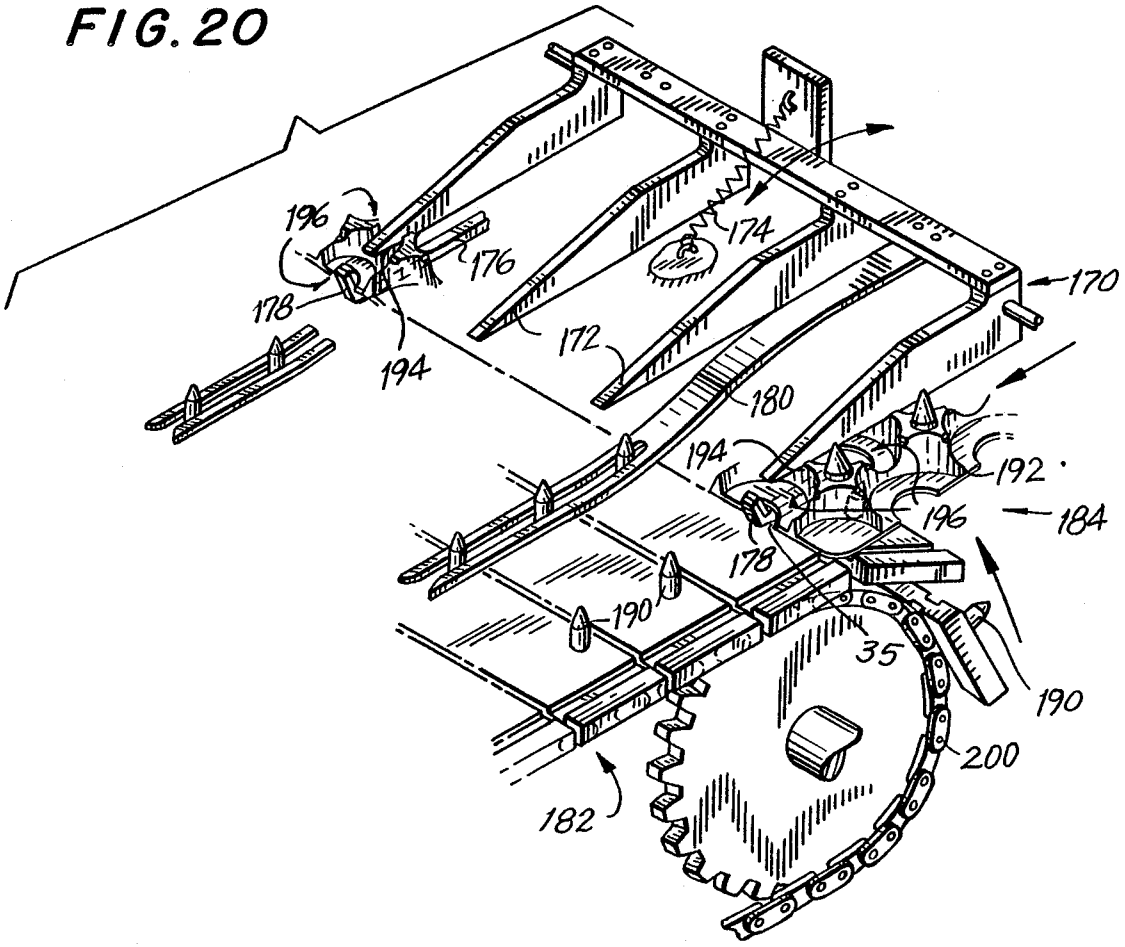
FIG. 20 is a perspective, exploded and cut-away view illustrating the seating of cans in a spacer tray in the spacer-tray loading machine of FIG. 1.

Turning now to FIG. 20, a tray-hold-down-finger assembly 170 is pivotally attached to a housing of the tray loader 4 (not shown). As may be seen in FIG. 15, the tray-hold-down-finger assembly 170 is located beneath a lower portion of the can-feed-queue ramp 140. Returning to FIG. 20, the tray-hold-down-finger assembly 170 has four tray-hold-down fingers 172 which extend substantially parallel to one another in a downstream direction. The spacing between adjacent tray-hold-down fingers 172 is substantially the same as the spacing between the centers of adjacent rows of can-bottom receptacles in a spacer tray. The tray-hold-down-finger assembly 170 is biased by a hold-down bias spring 174 so that ends of the tray-hold-down fingers 172 are urged to rotate in a downward direction. Two tray retainer fingers 176 are located substantially directly beneath two outermost tray-hold-down fingers 172 and extend in a substantially downstream direction. An end of each tray retainer finger 176 is turned upward to form a tray retainer catch 178.

Two tray insertion stabilizer springs 180 are connected to the tray-hold-down-finger assembly 170 and extend in a downstream direction centrally between the outer pairs of tray-hold-down-fingers 172.

Figure 17:
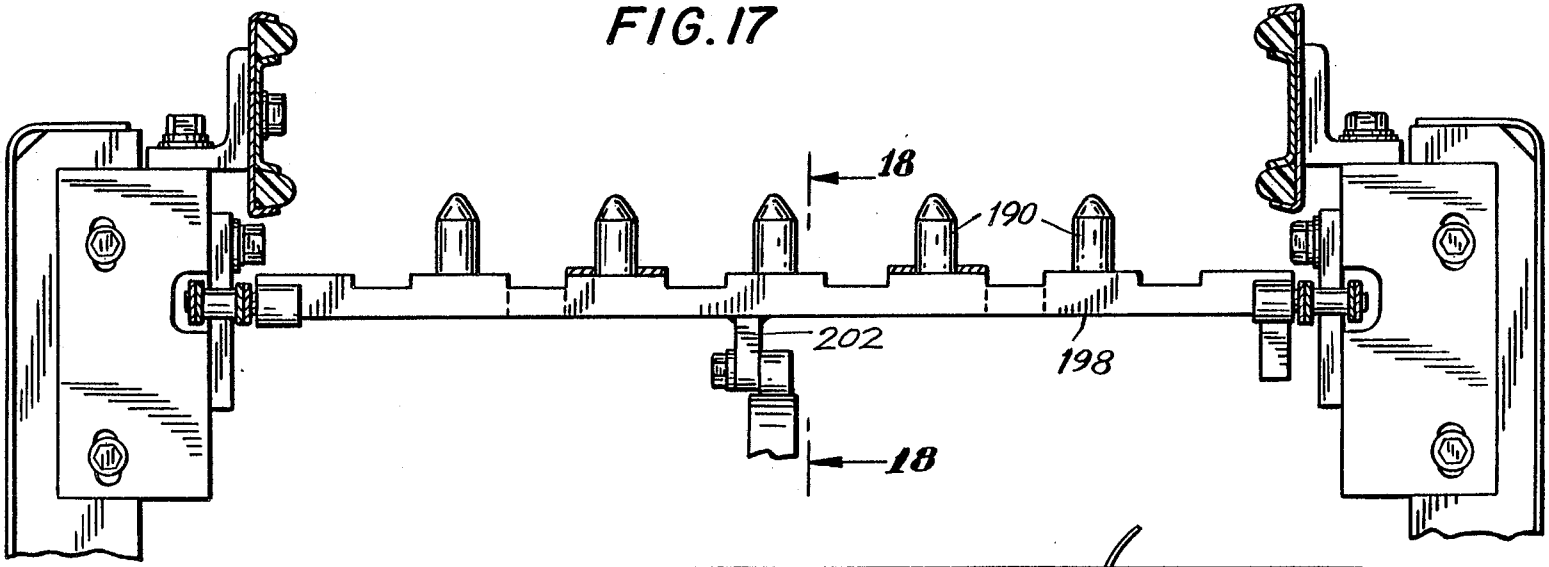
FIG. 17 is a cross-sectional view taken along line 17—17 of FIG. 3.

A guide-pin segmented conveyor 182 extends generally horizontally from a guide-pin insertion station 184 substantially in a downstream direction to a guide-pin withdrawal station 186, shown in FIGS. 25 and 26. As shown best in FIG. 25, the guide-pin segmented conveyor 182 has guide-pin arrays 188 mounted on it. Each guide-pin array 184 has fifteen can-loading guide-pins 190 positioned to align with the fifteen can-loading guide-pin caps 58 formed in the spacer trays. The five-by-three arrays of fifteen can-loading guide-pins 190 are oriented on the guide-pin segmented conveyor 182 with the rows of five guide pins extending transversely to the downstream direction of motion of the conveyor, with each row of five can-loading guide-pins being mounted on a single segment of the segmented conveyor, as may be seen in FIG. 17. As shown best in FIG. 19, ends of the can-loading guide-pins 190 are shaped to be approximately complementary of inside surfaces of the can-loading guide-pin caps 58 of the spacer trays.

Turning again to FIG. 20, the tray-hold-down assembly 170 and the two tray retainer fingers 176 cooperate to retain a first spacer tray 192 in the tray-feed-queue at the guide-pin insertion station 184. The first spacer tray 192 is urged towards the guide-pin segmented conveyor 182 by the downstream motion of the tray-feed-queue conveyor 77 in part applied by means of the queue of spacer trays on the conveyor. The tray-hold-down fingers 172 of the tray-hold-down-finger assembly 170 urge against the spacer walls 194 located between four central pairs of can-bottom receptacles 196 of the spacer tray 192. The tray retainer catch 178 of each of the two tray retainer fingers 176 projects through one of two long-side retainer cut-outs 35 at the leading edge of the spacer tray to restrain the tray against downstream motion.

Figure 18:
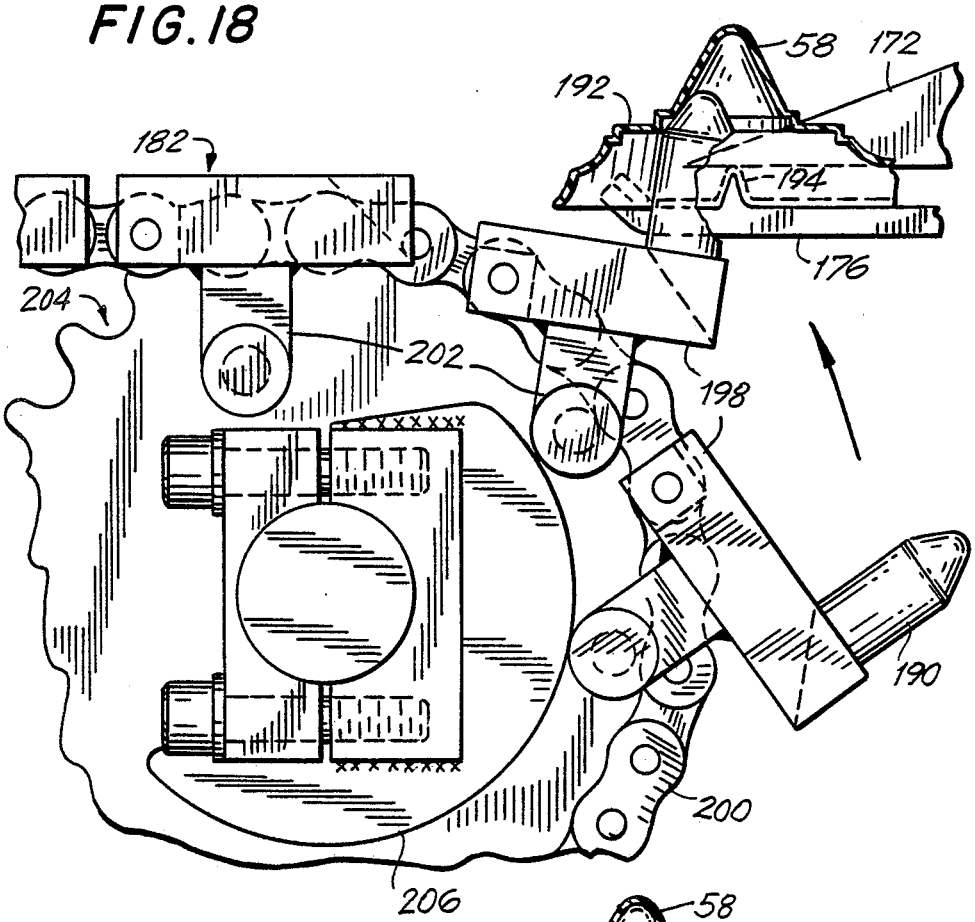
FIGS. 18 and 19 are cross-sectional views taken along line 18—18 of FIG. 16 illustrating different stages in the operation of the spacer-tray loading machine of FIG. 1.
Figure 19:
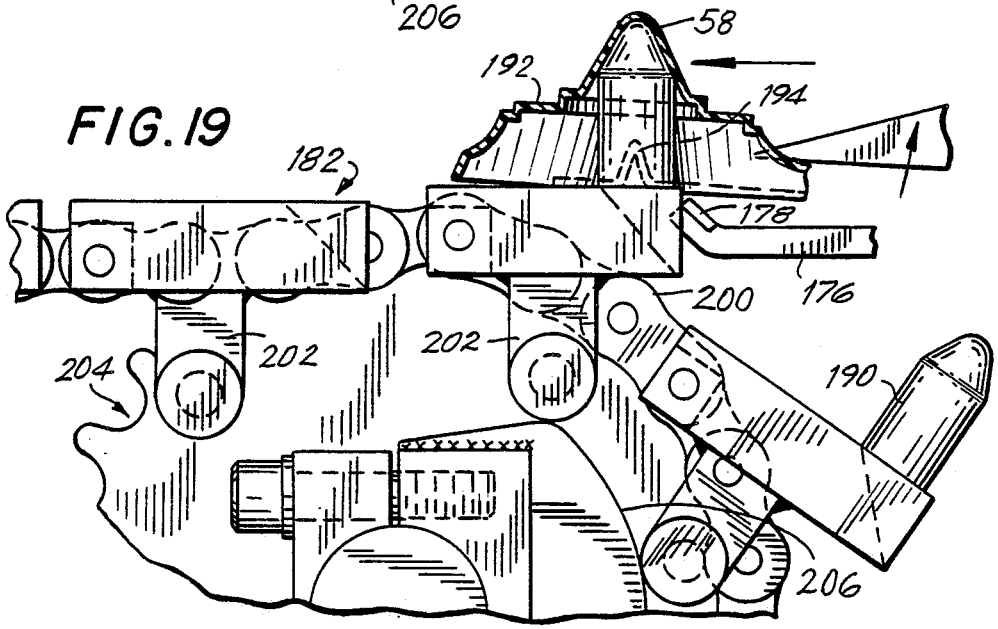

As shown best in FIGS. 18 and 19, conveyor segments 198 of the guide-pin segmented conveyor 182 are connected by a conveyor link chain 200. Each conveyor segment 198 has a conveyor segment cam follower 202 projecting from an underside of the segment when the conveyor segment is in a horizontal rest position. The conveyor link chain 200 of the guide-pin segmented conveyor 182 engages a rotatable sprocket wheel 204 at the guide-pin insertion station. A guide-pin insertion cam 206 is nonrotatably mounted generally coaxially with the rotatable sprocket wheel 204. As the sprocket wheel 204 rotates, the conveyor segments 198 advance past the guide-pin insertion cam 206. The conveyor segment cam followers 202 roll against the guide-pin insertion cam 206 causing the conveyor segments 198 to pivot as they advance around the sprocket wheel 204. The guide-pin insertion cam 206 is shaped so that the motion of a guide pin attached to a conveyor segment 198 as the segment approaches the top of the sprocket wheel 204 is essentially a vertical motion, with very little, if any, horizontal component.

The tray retainer catch 178 locates the spacer tray 192 at a position in which the five guide pins 190 of the conveyor segment 198 advance into the five can-loading-guide-pin caps 58 of the spacer tray. The vertical motion of the guide pins 190 causes the spacer tray 192 to be lifted up against the downward bias of the tray-hold-down fingers 172, causing the tray-hold-down-finger assembly 170 to pivot upwardly and allowing the spacer tray to be pulled up over the tray retainer catches 178 of the spacer-tray retainer fingers 176 as the guide pins 190 resume motion in a downstream direction. Continued advancement of the guide-pin segmented conveyor 182 causes the remaining guide pins 190 of the guide-pin array to be inserted in the remaining can-loading-guide-pin caps 58 of the spacer tray.

Turning again to FIG. 20, the tray insertion stabilizer springs 180 urge the spacer tray against the guide-pin segmented conveyor 182 as the spacer tray is translated away from the guide-pin insertion station 184. After the spacer tray clears the tray-hold-down fingers 172, the tray-hold-down-finger assembly 170 pivots back downward and in concert with the tray retainer fingers 176 retains the next spacer tray advancing from the tray feed queue.

As shown in FIG. 15, the guide-pin segmented conveyor 182 translates the spacer tray under the slide extension finger 158. The movement of the guide-pin segmented conveyor 182 is synchronized with the rotation of the can-loading metering wheel 150 so that the cans are moving at the same velocity as the spacer tray when the spacer tray passes under the end of the downwardly inclined ramp portion 162 of the slide extension finger 158. Cans advanced by the can-loading metering wheel 150 drop by their own weight from the wheel and into the can-bottom receptacles of the spacer tray passing under the slide finger extension 158, thereby loading the spacer tray with the cans. The can-loading guide pins 190 inserted in the can-loading-guide-pin caps 58 of the spacer tray assists in guiding the base portions of the cans into the can-bottom receptacles of the spacer tray.

Figures 21, 22:
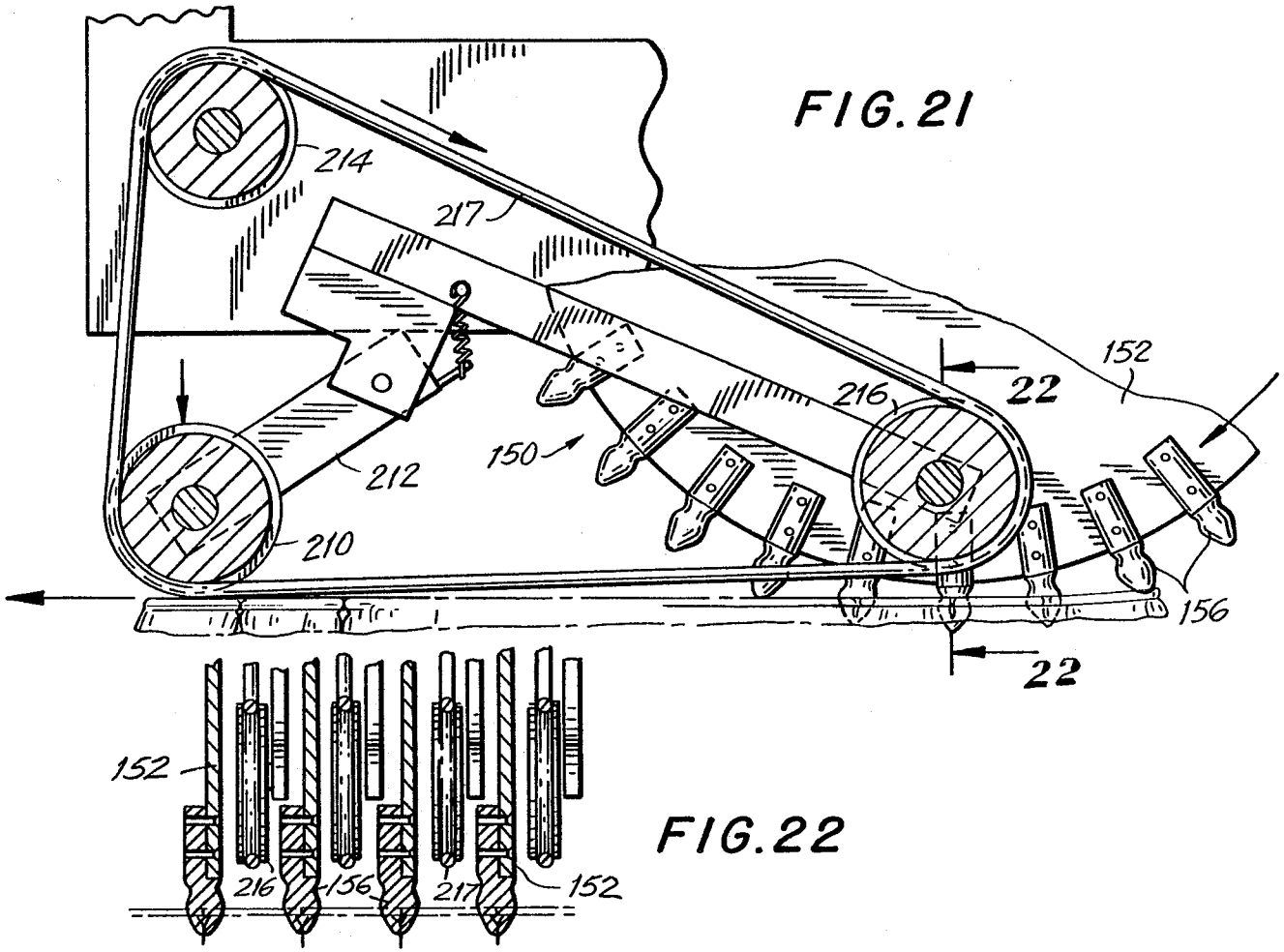
FIG. 21 is a cross-sectional view taken along line 21—21 of FIG. 1.
FIG. 22 is a cross-sectional view taken along line 22—22 of FIG. 21.
Figure 23:
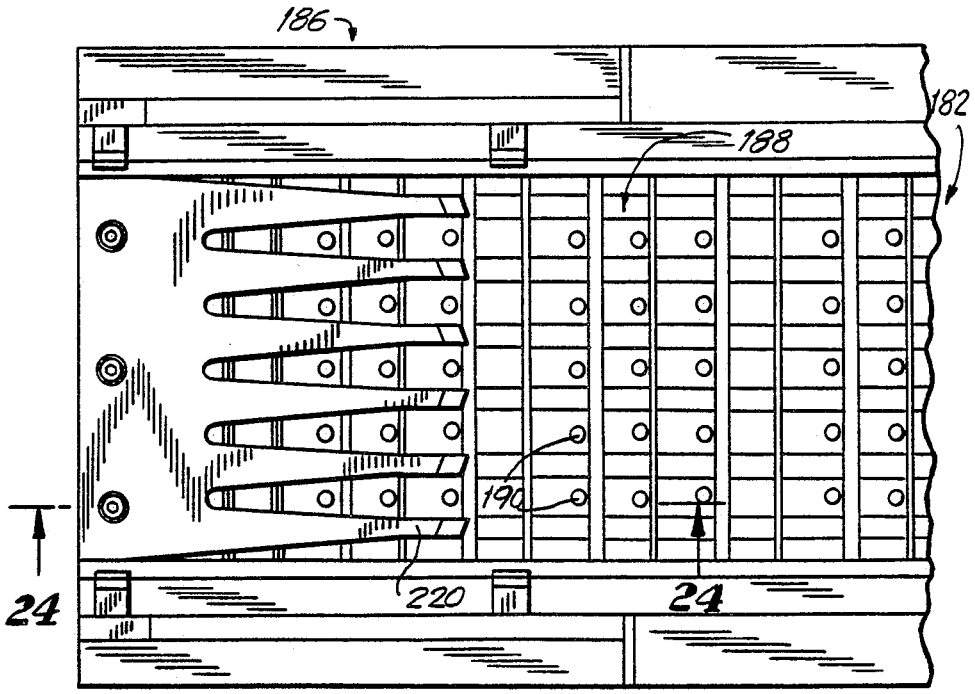
FIG. 23 is a top view of a guide-pin withdrawal station of the spacer-tray loading machine of FIG. 1.
Figure 24:
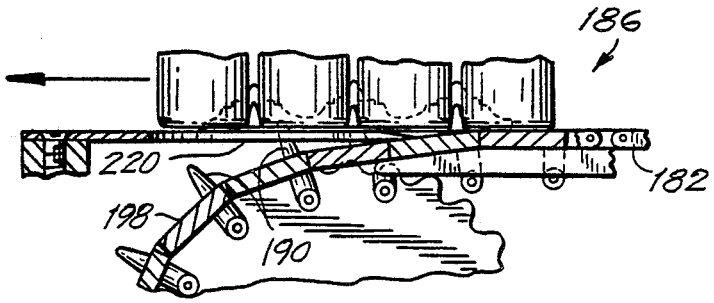
FIG. 24 is a cross-sectional view taken along line 24—24 of FIG. 23.

Turning now to FIG. 21, a can push-down belt assembly is located generally above the tops of the cans on a downstream side of the can-loading metering wheel 150. A push-down idler pulley wheel 210 is mounted at an end of a push-down pivot arm 212 which is pivotally mounted to a housing of the tray loader 4. The push-down pivot arm 212 is spring biased to urge the push-down pulley wheel downward. A pulley drive wheel 214 and a pulley idler wheel 216 form a triangular arrangement with the push-down pulley wheel 210. As may been seen in FIGS. 21 and 22, the pulley idler wheel 216 is located between adjacent can-metering disks 152 of the can-loading metering wheel 150. A round polyurethane belt 217 passes over the push-down pulley wheel 210, the pulley drive wheel 214, and the pulley idler wheel 216. As noted above, under normal operating conditions cans drop into the can-bottom receptacles of the spacer trays passing through the tray loader 4 and seat themselves in the receptacles by their own weight. However, occasionally a spacer tray is deformed and does not fully accept a can, in which case the push-down pulley wheel 210 generally seats the can properly.

As shown in FIG. 26, the guide-pin segmented conveyor 182 advances loaded spacer trays to a guide-pin withdrawal station 186 where the can-loading guide-pins 190 are withdrawn from the can-loading-guide-pin caps 58 of the spacer tray as the motion of the guide-pin segmented conveyor 182 inclines downwardly from horizontal. Guide pins are withdrawn at the guide-pin withdrawal station 186 from between spacer-tray lift-off fingers 220. The spacer-tray lift-off fingers 220 have tapered upstream ends to straighten bent corners of spacer trays passing over the fingers. The spacer tray thus loaded with cans is then withdrawn from the tray loader 4 by a loaded-tray conveyor belt (not shown) for transportation to a shrink wrapping machine (not shown).

It is not intended to limit the present invention to the specific embodiments described above. For example, the tray loading machine may load containers in four, eight, twelve or other number of container lanes. Nestable trays other than spacer trays of the '437 patent may be used. It is recognized that changes may be made in the spacer tray loading machines described herein without departing from the scope and teaching of the instant invention and it is intended to encompass all embodiments, alterations and modifications consistent with the invention.

We claim:

1. A spacer-tray loading machine for loading nestable spacer trays comprising:

(a) rotatable metering wheel for inserting containers into said spacer trays;

(b) a tray-stack retainer assembly for retaining stack of spacer trays; and (c) a pull-and-drop assembly to selectively remove individual spacer trays from a downstream end of said stack of spacer trays.

2. A spacer-trays loading machine for claim 1 wherein said tray-stack retainer assembly comprises:

(a) a stacked-tray supply conveyor for conveying said spacer trays from an upstream end of said stacked-tray supply conveyor towards a downstream end of said stacked-tray supply conveyor;

(b) a tray-stack pusher box operatively associated with said stacked-tray supply conveyor for adjustably urging said spacer trays in a downstream direction and against each other, thus forming a stack of spacer trays; and (c) a tray feeder for receiving individual spacer trays from a downstream end of said stack of spacer trays.

3. The spacer-tray loading machine of claim 1 further comprising at least one tray-lift-rail for selectively lifting at least a portion of said stack of spacer trays away from said stacked-tray supply conveyor so as to selectively maintain pressure on spacer trays located at a downstream end of said stack of spacer trays, wherein said spacer trays are vertically positioned, horizontally stacked and a bottom edge of said spacer trays contact said stacked-tray supply conveyor.

4. A spacer-tray loading machine of claim 1 wherein said tray-stack retainer assembly comprises:

(a) a stacked-tray supply conveyor for conveying said spacer trays from an upstream end of said stacked-tray supply conveyor towards a downstream end of said stacked-tray supply conveyor; and (b) a removable spacer-tray support platform located at a downstream end of said stacked-tray supply conveyor;

(c) wherein said removable spacer-tray support platform includes a stack lift ramp at an upstream end of said support platform to raise and align spacer trays.

5. The spacer-tray loading machine of claim 1 wherein said tray-stack retainer assembly comprises:

(a) a retainer frame through which said individual spacer trays pass; and (b) a plurality of retainer blades to mate with and selectively engage retainer cutouts located in spacer trays.

6. The spacer-tray loading machine of claim 1 wherein said pull-and-drop assembly comprises:

(a) a pull-and-drop arm pivotable between a tray-contact orientation in which a most downstream spacer tray of said stack of spacer trays is contacted and retained, and a tray-drop orientation in which said contacted and retained spacer tray may be dropped;

(b) a plurality of pull-and-drop suckers mounted to said pull-and-drop arm, said pull-and-drop suckers having surfaces to mate with said contacted and retained spacer tray so as to firmly hold said contacted and retained spacer tray while said pull-and-drop arm pivots from said tray-contact orientation to said tray-drop orientation; and (c) at least one air-blast nozzle to selectively urge and re-orient said spacer tray.

7. The space-tray loading machine of claim 6 further comprising:

(a) a tray-feeding-queue conveyor for receiving said selectively urged and re-oriented spacer tray;

(b) at least one tray-feed-queue guide rod operatively associated with said air-blast nozzle and said tray-feed-queue conveyor to guide said selectively urged and re-oriented spacer tray; and (c) a tray-feed-queue-full detector to detect when spacer trays are queued up on said tray-feed-queue conveyor, and to prevent additional spacer trays from queuing on said tray-feed-queue conveyor.

8. A tray loading machine for loading containers into trays comprising:

(a) a rotatable metering wheel for inserting said containers into said trays;

(b) tray input queue means for providing said metering wheel with a supply of trays;

(c) a tray supply line for supplying stacked trays to said metering wheel;

(d) tray feeding means for individually selecting a most downstream tray from said stacked tray supply line and transferring said most downstream tray to said tray input queue, said tray feeding means having:

(i) a retainer frame through which said trays pass one at a time from said tray supply line;

(ii) a plurality of retainer blades to mate with and selectively engage retainer cutouts located in said trays;

(iii) a pivotally mounted pull-and-drop arm pivotable between a tray-contact orientation in which a most downstream tray of said stacked trays is contacted and retained, and a tray-drop orientation in which said contacted anD retained tray may be dropped;

(iv) a plurality of pull-and-drop suckers mounted to said pull-and-drop arm, said pull-and-drop suckers having surfaces to mate with said contacted and retained tray so as to firmly hold said contacted and retained tray while said pull-and-drop arm pivots from said tray-contact orientation to said tray-drop orientation; and (v) orientation means to selectively urge and orient said spacer tray into said input queue;

(e) container input queue means for providing said metering wheel with a supply of containers;

(f) wherein said rotatable metering wheel urges containers from said container input queue means against said trays from said tray input queue means so as to insert said containers into said trays.

9. The tray loading machine of claim 8 wherein said rotatable metering wheel comprises a rotatable cylinder having a plurality of radially projecting container-top locating pins which continuously matingly engage a plurality of containers from said container input queue means, and which insert such engaged containers into trays from said tray input queue means and which disengage said containers from said container-top locating pins.

10. The tray loading machine of claim 9 further comprising means for transporting trays with inserted containers away from said metering wheel.

11. The tray loading machine of claim 9 wherein said container-top locating pins of said metering wheel, upon engaging containers, causes such containers to be advanced under said metering wheel in synchronism with the rotation of said metering wheel, and wherein a downstream end of said container input queue means provides such containers to said metering wheel.

12. The tray loading machine of claim 8 wherein said orientation means comprises at least one air-blast nozzle.

13. A spacer-tray loading machine for loading nestable spacer trays comprising:

(a) a rotatable metering wheel for inserting containers into said spacer trays;

(b) spacer tray input queue means for providing said metering wheel with a supply of trays;

(c) a spacer tray supply line for supplying stacked spacer trays;

(d) spacer tray feeding means for individually selecting a most downstream spacer tray from said stacked trays and transferring said most downstream spacer tray to said spacer tray input queue;

(e) container input queue means for providing said metering wheel with a supply of containers; and (f) means for detecting interruptions in the transport of containers.

14. The spacer-tray loading machine of claim 13 wherein said means for detecting interruptions comprises a plurality of six-channel proximity switches which output control signals and which detect the proximity of metal containers in each of six rows of containers in said container input queue means.

15. The spacer-tray loading machine of claim 14 wherein each six-channel proximity switch comprises two groups of three proximity switches cantilevered over said container input queue means.

16. The spacer-tray loading machine of claim 15 further comprising a control circuit which receives said control signals from said plurality of six-channel proximity switches and which regulates the speed of operation of said spacer-tray loading machine in accordance with said control signals.

17. A spacer-tray loading machine for loading nestable spacer trays comprising:

(a) a rotatable metering wheel for inserting said containers into said spacer trays;

(b) spacer tray input queue means for providing said metering wheel with a supply of spacer trays;

(c) container input queue means for providing said metering wheel with a supply of containers;

(d) a rotatable pressure relief drum located downstream from said metering wheel and having a plurality of container-top engagement projections projecting radially outward for partially insertion into gaps between the tops of containers contacting said pressure relief drum so as to selectively control the flow of containers past said pressure relief drum.

18. The spacer-tray loading machine of claim 17 further comprising a plurality of stationary container-stripper fingers projecting at least partially between said container-top engagement projections such that as said pressure relief drum rotates and controls the flow of containers, said container-stripper fingers insure separation between containers and said pressure relief drum.

19. The spacer-tray loading machine of claim 17 wherein a rate of rotation of said pressure relief drum is synchronized with a rate at which containers are loaded into said spacer trays.

20. A spacer-tray loading machine for loading nestable spacer trays comprising:

(a) a stacked-tray supply conveyor for conveying said spacer trays from an upstream end of said stacked-tray supply conveyor towards a downstream end of said stacked-tray supply conveyor;

(b) a tray feeder for receiving individually spacer trays from a downstream end of said stack of spacer trays and feeding a tray-feed-queue conveyor;

(c) a tray loader for loading said spacer trays with containers;

(d) a container-feed-queue ramp for queuing containers prior to loading in said tray loader;

(e) a rotatable container-loading metering wheel connected to said tray loader and having a plurality of radially projecting container-top locating pins for matingly engaging a plurality of containers; and (f) means for transporting spacer trays under said metering wheel, said means for transporting spacer trays receiving said spacer trays from said tray-feed-queue conveyor.

21. The spacer-tray loading machine of claim 20 wherein said container-top locating pins of said container-loading metering wheel, upon engaging containers, causes such containers to be advanced under said metering wheel in synchronism with the rotation of said metering wheel, and wherein a downstream end of said container-feed-queue ramp provides such containers to said metering wheel and said means for transporting spacer trays under said metering wheel.

22. The spacer-tray loading machine of claim 21 further comprising a slide-extension finger pivotally attached at a first end to a lower end of said container-feed-queue support slide, said first end of said slide-extension finger being shaped to have an arcuate upper surface which has a center of curvature located approximately on a centerline of said container-loading metering wheel, and a second end, opposite said first end, of said slide-extension finger being shaped to form a downwardly inclined ramp, such that lower portions of containers being advanced across said arcuate upper surface of said slide-extension finger tend to spread apart from one another and to remain spread apart as the containers pass over said downwardly inclined ramp of said slide-extension finger to mate with a mating spacer tray provided from said means for transporting spacer trays and said tray-feed-queue conveyor.

23. The spacer-tray loading machine of claim 20 further comprising:

(a) a plurality of pivotally mounted hold-down fingers for biasing downward a most downstream spacer tray on said downstream end of said tray-feed-queue conveyor; and (b) a tray retainer catch for retaining said most downstream spacer tray at said downstream end.

24. A spacer-tray loading machine for loading nestable spacer trays comprising:

(a) a rotatable metering wheel for inserting said containers into said trays;

(b) tray input queue means for providing said metering wheel with a supply of trays;

(c) a tray supply line for supplying stacked trays;

(d) tray feeding means for individually selecting a most downstream tray from said stacked trays and transferring said most downstream tray to said tray input queue means;

(e) container input queue means for providing said metering wheel with a supply of containers;

(f) a segmented conveyor for transporting trays away from said metering wheel having during the loading of said trays; said segmented conveyor a plurality of connected segments;

(g) a plurality of container-loading guide pins inserted into at least some of said segments and projecting outwards; and (h) a cam follower connected to said segments which have said container-loading guide pins inserted therein;

(i) wherein when said cam follower of said segment having said cam follower follows a cam, said container-loading guide pin mates with said most downstream spacer tray and lifts said most downstream spacer tray upwards, thereby releasing said most downstream spacer tray from said tray retainer catch.

25. The spacer-tray loading machine of claim 24 wherein said cam is non-rotatable, said container-loading guide pin mates with said most downstream tray by vertical insertion into cam-loading guide-pin caps of said spacer trays and said hold-down fingers are partially raised by said container-loading guide pins being vertically inserted into said container-loading guide pin caps.

26. A spacer-tray loading machine for loading nestable spacer tray comprising:

(a) a rotatable metering wheel for inserting said containers into said trays;

(b) tray input queue means for providing said metering wheel with a supply of trays;

(c) a tray supply line for supplying stacked trays;

(d) tray feeding means for individually selecting a most downstream tray from said stacked trays and transferring said most downstream tray to said tray input queue means;

(e) container input queue means for providing said metering wheel with a supply of containers; and (f) a push-down belt assembly for separating containers from said metering wheel.

27. The space-tray loading machine of claim 26 wherein said push-down belt assembly comprises a plurality of driven belts which are placed downstream from said metering wheel and which urge containers downward.

* * * * *